US008956128B2

(12) United States Patent
Wang et al.

(10) Patent No.: US 8,956,128 B2
(45) Date of Patent: Feb. 17, 2015

(54) SPHERICAL EXPANSION COMPRESSOR ADAPTED TO VARIABLE WORKING CONDITIONS

(75) Inventors: Luyi Wang, Xi'an (CN); Nan Xia, Xi'an (CN)

(73) Assignee: Xi'An Zhengan Environmental Technology Co., Ltd. (CN)

( * ) Notice: Subject to any disclaimer, the term of this patent is extended or adjusted under 35 U.S.C. 154(b) by 325 days.

(21) Appl. No.: 13/499,685

(22) PCT Filed: Jul. 30, 2010

(86) PCT No.: PCT/CN2010/075593

§ 371 (c)(1),
(2), (4) Date: Mar. 30, 2012

(87) PCT Pub. No.: WO2011/038617

PCT Pub. Date: Apr. 7, 2011

(65) Prior Publication Data

US 2012/0189479 A1 Jul. 26, 2012

(30) Foreign Application Priority Data

Sep. 30, 2009 (CN) ..... 2009 1 0024200

(51) Int. Cl.
*F04B 25/00* (2006.01)
*F04B 3/00* (2006.01)
(Continued)

(52) U.S. Cl.
CPC ..... *F04C 18/54* (2013.01); *F04C 18/3562* (2013.01); *F04C 23/001* (2013.01);
(Continued)

(58) Field of Classification Search
USPC ..... 417/410.3, 253
See application file for complete search history.

(56) References Cited

U.S. PATENT DOCUMENTS 1,969,076 A * 8/1934 Hirsch ..... 417/250
2,621,852 A 12/1952 Pisa
(Continued)

FOREIGN PATENT DOCUMENTS

CN 85100200 A 9/1986
CN 2607458 Y 3/2004
(Continued)

OTHER PUBLICATIONS

Machine translation of foreign document: Wang, Luyi: WO 2008034331 A1 Publication date Mar. 2008; Title "Ball-shape Compressor and Expansion compressor capable of realizing multi-stage compression".*
(Continued)

*Primary Examiner* — Bryan Lettman
*Assistant Examiner* — Lilya Pekarskaya
(74) *Attorney, Agent, or Firm* — Leech Tishman Fuscaldo & Lampl; Laura M. Lloyd

(57) ABSTRACT

A spherical expansion compressor adapted to variable working conditions with a spherical inner chamber, comprises a rolling rotor compressor used as first-stage compression, compression working chambers, expansion working chambers, a gas tank and a pressure control circuit. The pressure control circuit is between the gas tank and a pressure-controlled inlet valve of the rolling rotor compressor, and controls the inlet valve to open/close according to pressure in the gas tank and maintains constant pressure in the tank. A working medium after first-stage compression enters the gas tank, where the pressure control circuit regulates the gas tank pressure. The working medium enters second-stage compression, and expands in the expansion-stage, forming the spherical expansion compressor adapted to variable working conditions.

19 Claims, 12 Drawing Sheets

(51) Int. Cl.

| | |
|---|---|
| ***F04B 5/00*** | (2006.01) |
| ***F04B 35/00*** | (2006.01) |
| ***F04B 17/00*** | (2006.01) |
| ***F04C 11/00*** | (2006.01) |
| ***F04C 13/00*** | (2006.01) |
| ***F04C 18/00*** | (2006.01) |
| ***F03C 2/00*** | (2006.01) |
| ***F04C 18/54*** | (2006.01) |
| ***F04C 18/356*** | (2006.01) |
| ***F04C 23/00*** | (2006.01) |
| ***F04C 28/06*** | (2006.01) |
| ***F04C 28/24*** | (2006.01) |
| ***F04C 28/26*** | (2006.01) |
| ***F04B 49/02*** | (2006.01) |

(52) U.S. Cl.

CPC ..... *F04C23/005* (2013.01); *F04C 28/06* (2013.01); *F04C 28/24* (2013.01); *F04C 28/26* (2013.01); *F04B 49/02* (2013.01)

USPC ..... 417/253; 417/245; 417/377; 418/5; 418/60; 418/63

(56) References Cited

U.S. PATENT DOCUMENTS

| | | | | |
|---|---|---|---|---|
| 2003/0172666 | A1 * | 9/2003 | Matsumoto et al. ..... | 62/175 |
| 2005/0063849 | A1 * | 3/2005 | Cho et al. ..... | 418/23 |

FOREIGN PATENT DOCUMENTS

| | | | | |
|---|---|---|---|---|
| CN | 1932293 | A | 3/2007 | |
| CN | 200971863 | Y | 11/2007 | |
| CN | 201187448 | Y | 1/2009 | |
| CN | 101691864 | A | 4/2010 | |
| CN | 201513347 | U | 6/2010 | |
| JP | 2002061586 | A | 2/2002 | |
| WO | WO 2008034331 | A1 * | 3/2008 | ..... F04C 21/00 |

OTHER PUBLICATIONS

Ma, Lili et al., International Search Report issued for parent International Patent Application No. PCT/CN2010/075593 (with English translation).

Ma, Lili, Written Opinion of the International Searching Authority issued for parent International Patent Application No. PCT/CN2010/075593 (with English translation), Oct. 26, 2010.

* cited by examiner

SPHERICAL EXPANSION COMPRESSOR ADAPTED TO VARIABLE WORKING CONDITIONS

CROSS-REFERENCE TO RELATED APPLICATIONS

The present Application is a national stage of International Patent Application No. PCT/CN2010/075593, titled "Spherical Expansion Compressor Adapted to Variable Working Conditions," filed Jul. 30, 2010, which claims priority from Chinese Patent Application No. 200910024200.X, filed Sep. 30, 2009, the contents of which are incorporated in this disclosure by reference in their entirety.

TECHNICAL FIELD

The invention relates to a spherical expansion compressor, and in particular to a spherical expansion compressor adapted to variable working conditions.

BACKGROUND ART

New types of spherical expansion compressors were disclosed in Chinese Patent No. ZL200610104569.8, entitled "ball-shape compressor capable of realizing multi-stage compression", Chinese Patent No. ZL200620079799.9, entitled "$CO_2$ spherical expansion compressor", and Chinese Patent No. ZL200820028592.8, entitled "double-compressor opposed-type $CO_2$ spherical expansion compressor", which are advantageous over other known expansion compressors, such as compact structure, less parts, reliable sealing, powerful resistance to "liquid strike", less vibration, and high efficiency, etc., and are widely used in refrigeration, air conditioning, and other related fields.

However, all the above are compressors of fixed volume ratios, which are not adapted to variable working, conditions. It was found in further studies that the above-mentioned spherical expansion compressors may be designed more optimally, making them improved in comprehensive capabilities, and at the same time, adapted to variable working conditions.

SUMMARY OF THE INVENTION

The object of the invention is to create an innovative solution on the basis of Chinese Patent No. ZL200610104569.8, Chinese Patent No. ZL200620079799.9 and Chinese Patent No. ZL200820028592.8, thereby improving the comprehensive capabilities of spherical expansion compressors, and at the same time, making them adapted to variable working conditions.

The invention first provides a spherical expansion compressor adapted to variable working conditions and having a spherical inner chamber, the spherical expansion compressor comprises:

a rolling rotor compressor used as first-stage compression, with an exhaust valve being arranged at its outlet port and a pressure-controlled inlet valve being mounted at its inlet port;

compression working chambers used as at least second-stage compression and arranged in the spherical inner chamber;

expansion working chambers used as at least one-stage expansion and arranged in the spherical inner chamber;

a gas tank, with its inlet port being in communication with the exhaust valve of the rolling rotor compressor and its outlet port being in communication with an inlet port of the second-stage compression of the spherical expansion compressor, for supplying gas sources of constant pressure for the gas suction of the second-stage compression of the spherical expansion compressor; and a pressure control circuit arranged between the gas tank and the pressure-controlled inlet valve, for controlling the pressure-controlled inlet valve to open/close according to the pressure in the gas tank;

wherein when the pressure in the gas tank exceeds a set value, the pressure-controlled inlet valve is closed by the pressure control circuit, and when the pressure in the gas tank returns to the set value, the pressure-controlled inlet valve is opened and the rolling rotor compressor works normally. A working medium after the first-stage compression enters the gas tank, and the pressure in the tank is maintained constant through regulation by the pressure control circuit. After entering the second-stage compression, the working medium of constant pressure is expanded at an expansion stage, thereby forming the spherical expansion compressor adapted to variable working conditions.

The invention also provides a spherical expansion compressor adapted to variable working conditions, comprising:

a cylinder, with a main shaft hole being arranged thereon;

a cylinder head connected to the cylinder to form the spherical inner chamber, with a shaft hole matching a piston shaft being arranged on the cylinder head;

a piston having a spherical top surface, a piston shaft projecting from the center of the spherical top face, and a piston pin seat at the lower part of the piston, the piston being rotatable freely around the piston shaft in the shaft hole of the cylinder head, and the spherical top surface of the piston having the same spherical center as that of the spherical inner chamber and forming a hermetic running fit therewith; the piston pin seat being an inwards recessed semicylindrical hole formed at the lower end face of the piston, and there being a recessed sector-shaped cavity along the axial direction of the semicylindrical hole at the inner circumference of the semicylindrical hole, the sector-shaped cavity running through along the axial direction of the semicylindrical hole and being sector-shaped on a section perpendicular to the axis of the semicylindrical hole;

a rotary disk having a rotary disk shaft projecting from the center of the lower end face of the rotary disk and a rotary disk pin seat corresponding to the piston pin seat at the upper part of the rotary disk; the outer circumferential face between the upper part and lower end face of the rotary disk being a rotary disk spherical face, and the rotary disk spherical face having the same spherical center as that of the spherical inner chamber and closely confronting the spherical inner chamber, thereby forming a hermetic running fit therewith; the rotary disk pin seat being an annular body projecting from the upper part of the rotary disk, the axis of the annular body being the same axis as that of said semicylindrical hole of the piston, and the axis being perpendicular to the rotary disk shaft and the piston shaft and passing through the spherical center of the spherical inner chamber; and a convex sector-shaped bump being formed along the axial direction of the annular body on the outer circumference of the annular body of the rotary disk pin seat, the sector-shaped bump running through along the axial direction of the annular body, being sector-shaped on the annular face, and matching the sector-shaped cavity of the piston pin seat and having the same center of sector as that of the piston pin seat;

a main shaft with one end within the cylinder having an eccentric shaft hole, the eccentric shaft hole matching the rotary disk shaft and forming a cylindrical sliding bearing fit therewith, and the other end being, connected to a power mechanism for supplying power to vary the volume of the compressor;

piston hinge support with one end being a planar end and the other end being a spherical end face, the spherical end face matching the spherical inner chamber, the shapes of the planar end faces and side faces of the piston hinge supports matching the structures of the two ends of the piston pin seat and the two ends of the rotary disk pin seat, the piston hinge supports being fixed to the two ends of the semicylindrical hole of the piston pin seat, and a spherical face matching the spherical inner chamber being formed at the two ends of the piston pin seat and the two ends of the rotary disk pin seat; the piston hinge support having a pin hole therein which are coaxial with the semicylindrical hole of the piston pin seat, the pin hole being a blind hole arranged at the center of the planar end of a piston hinge support;

a central pin being inserted into the pin hole of a piston hinge support and an inner hole of the annular body of the rotary disk pin seat, such that the piston and the rotary disk form a cylindrical hinge connection;

a rolling rotor compressor having an eccentric structure on its main shaft, the eccentric structure being a rotor of the rolling rotor compressor, and a rotor cylinder of the rolling rotor compressor being positioned between said cylinder and a main shaft support, an inlet port being arranged on the rotor cylinder, an outlet port being arranged on the main shaft support, and a sliding piece and a sliding piece spring being mounted; an exhaust valve being arranged at the outlet port, and a pressure-controlled inlet valve being mounted at the inlet port; the rolling rotor compressor being used as first-stage compression of the spherical expansion compressor;

a gas tank, with its inlet port being in communication with the exhaust valve of the rolling, rotor compressor and its outlet port being in communication with a second-stage inlet port of the spherical expansion compressor, for supplying gas sources of constant pressure for the gas suction of the second-stave compression of the spherical expansion compressor; and a pressure control circuit, one end of the pressure control circuit being in communication with the pressure-controlled inlet valve and the other end being in communication with the gas tank; when the pressure in the gas tank exceeding a set value, the pressure-controlled inlet valve being closed by the pressure control circuit, and when the pressure in the gas tank returning to the set value, the pressure-controlled inlet valve being opened and the rolling rotor compressor working normally, thereby being adapted to variable working conditions;

wherein the axes of the piston shaft and of the rotary disk shaft form an identical angle $\alpha$ with respect to the axis of the main shaft, with an optimal range of value of $\alpha$ being 5°-15°;

wherein the moment of inertia of the piston around the axis of the piston is close to or equals to the moment of inertia of the rotary disk around the axis of the rotary disk;

wherein working chambers V7 and V8 whose volumes vary in an alternative manner are formed between the upper end face of the rotary disk, the lower end face of the piston, the planar end faces of a piston hinge supports and the spherical inner chamber by relative swinging of the piston and the rotary disk around the central pin, and at the same time, working chambers V5 and V6 whose volumes vary in an alternative manner are formed between a side of the sector-shaped bump, a side of the sector-shape cavity and the planar end faces of the piston hinge supports;

wherein both working chambers V5 and V6 correspond to respective a gas channel and inlet and outlet channels, the gas channel being arranged on the piston, and the inlet and outlet channels being arranged on the spherical inner chamber of the cylinder head, within an annular space perpendicular to the piston axis and in communication with the outside of the cylinder; the gas exhaust is controlled by the rotation of the piston, and when vas intake or exhaust is needed by each of the working chambers, the gas channel is in communication with the corresponding inlet and outlet channels; and the main shaft rotates clockwise when viewed along the direction of the main shaft from the cylinder head.

The invention has the following two structures according to different conditions of use:

i) the first structure: further comprising a slider, there being, a sector-shaped sliding channel at the lower part of the annular body of the rotary disk pin seat, the sector-shaped sliding channel being open in the axial direction of the annular body, the axis of the sector-shaped sliding, channel being parallel with the axis of the annular body, the shape of the slider matching the shape of the sector-shaped sliding channel, the upper and lower circular faces of the slider closely confronting the upper and lower circular faces of the sliding channel and forming, a hermetic running fit, and the two end faces of the slider being abutted against the piston hinge support and connected by positioning bolts; when the piston swings relative to the rotary disk, working chambers V3 and V4 whose volumes vary in an alternative manner being, formed between a side of the slider, a side of the sliding channel and the planar end faces of the piston hinge supports; the working chambers V3 and V4 corresponding to a gas channel and inlet and outlet channels respectively; the gas channel being arranged on the piston hinge support, and the inlet and outlet channels being arranged within the annular space perpendicular to the piston axis and in communication with the outside of the cylinder; the gas exhaust is controlled by the rotation of the piston, and when gas intake or exhaust is needed by each of the working chambers, the gas channel being in communication with the corresponding inlet and outlet channels;

a through hole channel being arranged on the rotary disk and connecting the working chambers V7 and V8, such that the working chambers V7 and V8 are unable to compress, thereby forming a non-compressed volume; and a cylinder head drain hole being arranged in the cylinder head, for discharging such substances as lubricant, etc. possibly accumulated in the non-compressed volume; and the rolling rotor compressor being used as first-stage compression, the working chambers V3 and V4 being used as second-stage compression, and the working chambers V5 and V6 being used as expansion, thereby forming a compressor of two-stage compression and one-stage expansion adapted to variable working, conditions;

ii) the second structure: further comprising a supporting bushing, there being an arcuate opening at the lower part of the rotary disk pin seat, the arcuate opening being open in the axial direction of the annular body, the axis of the arcuate opening being parallel with the axis of the annular body, the supporting bushing being of a cylindrical shape with through holes therein for bolts therethrough, the supporting bushing being movable within the arcuate opening, and the two end faces of the cylindrical supporting bushing being abutted against the planar end face of the piston hinge support and connected by positioning bolts; a rotary disk drain hole being arranged in the rotary disk and connecting the lower part of the arcuate opening and the root of the lower end of the sphere of the rotary disk, thereby discharging the liquid possibly accumulated in the inner chamber of the arcuate opening and preventing liquid strike;

the working chambers V7 and V8 corresponding to a gas channel and inlet and outlet channels respectively; the gas channel of the working chambers V7 and V8 being arranged within the piston hinge support, with one end of the gas channel being on the spherical surface of the piston, and the other end being on the lower end face of the piston and in communication with a guiding slot on the lower end face and close to the spherical surface; the inlet and outlet channels of the working chambers V7 and V8 being arranged on an inner face of the spherical inner chamber of the cylinder head and within the annular space perpendicular to the piston axis and in communication with the outside of the cylinder; and the gas exhaust is controlled by the rotation of the piston, and when gas intake or exhaust is needed by each of the working chambers, the gas channel being in communication with the corresponding inlet and outlet channels;

the rolling rotor compressor being used as first-stage compression, the working chambers V7 and V8 being used as second-stage compression, and the working chambers V5 and V6 being used as expansion, thereby forming an expansion compressor of two-stage compression and one-stage expansion adapted to variable working conditions.

The selection of a pair of volumes as compression or expansion is variable, which may be realized only if the design of a corresponding gas port is matched.

The advantages of the invention are as follows, 1) hermeticity is improved: the width of hermetic face is increased and leakage is reduced, and at the same time, the positioning screws in the piston assembly being substituted by bolt connection reduces the deformation of the slider, increases the rigidity of the machine, and improves the hermeticity;

2) adaptation to variable working conditions: since constant pressure of the rolling, rotor compressor is used and a control system is equipped, the whole machine is adapted to variable working conditions;

3) structure is optimized: an optimal range of value of is proposed, and the structures of the piston and the rotary disk are chosen so that the moment of inertia of the piston equals or is close to the moment of inertia of the rotary disk, which is significant for structure optimization; and 4) the cost is reduced: the spherical bearing is not used, and the structure is simplified without affecting the operation, thereby reducing the cost.

REFERENCE NUMBERS CITED IN THE DRAWINGS

Figure 1:
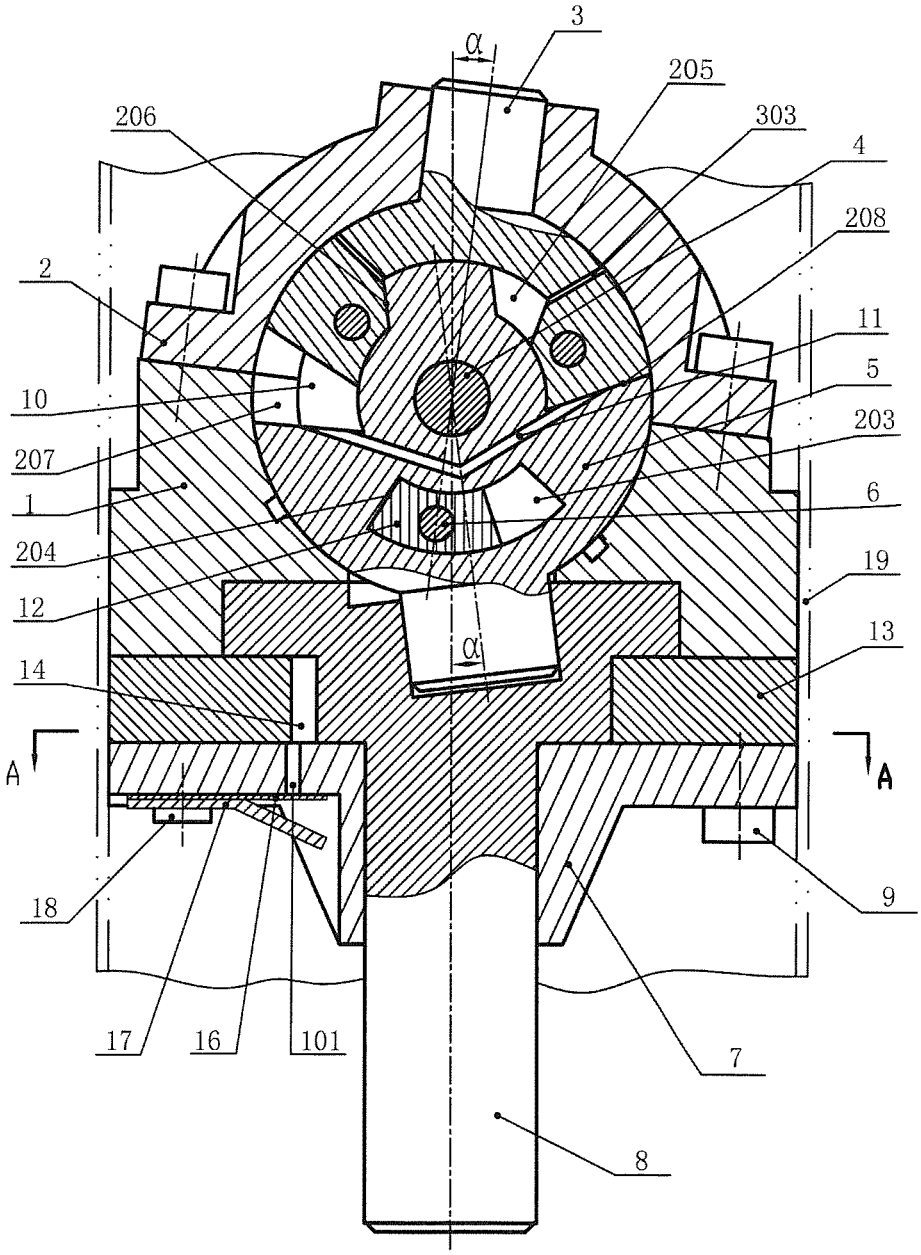
FIG. 1 is a sectional view of a structure of the first embodiment according to the invention.
Figure 2:
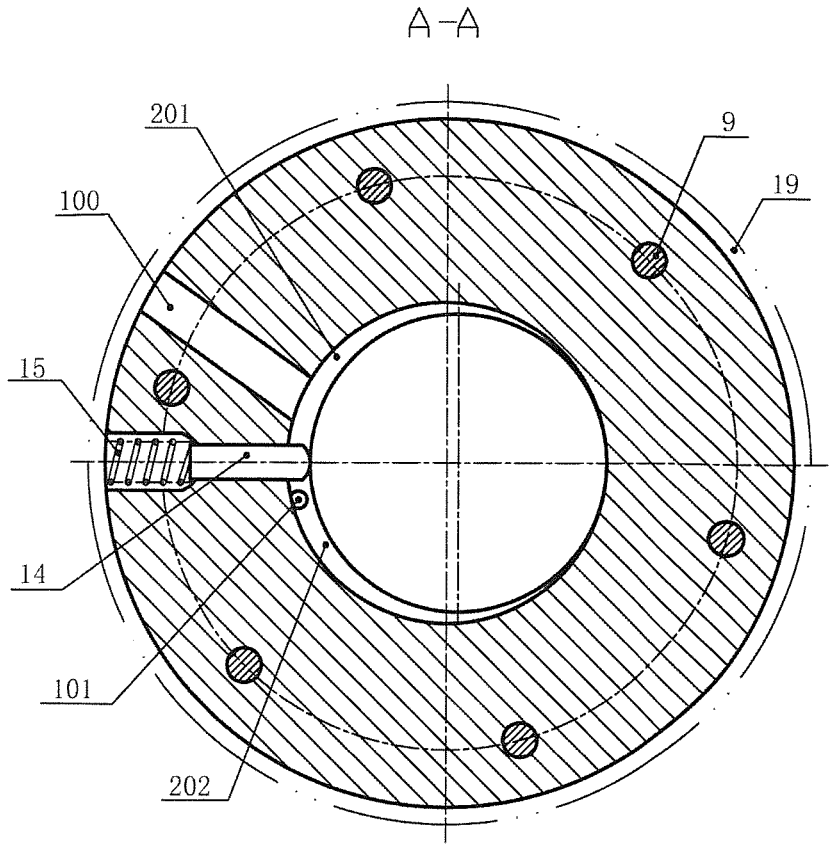
FIG. 2 is a sectional view taken along line A-A in FIG. 1.

1 cylinder;
2 cylinder head;
3 piston;
4 central pin;
5 rotary disk;
6 positioning bolt;
7 main shaft support;
8 main shaft;
9 connecting screw;
10 piston hinge support;
11 through hole channel;
12 slider;
13 rotor cylinder;
14 sliding piece;
15 sliding piece spring;
16 exhaust valve;
17 valve limiter;
18 valve screw;
19 housing;
20 cylinder head drain hole;
21 nut;
22 cylinder II;
23 cylinder head II;
24 piston II;
25 rotary disk II;

26 piston hinge support II;
27 guiding slot;
28 supporting bushing;
29 rotary disk drain hole;
100 rolling rotor inlet port;
101 rolling rotor outlet port;
102 inlet and outlet channels of working chambers V3 and V4;
103 inlet and outlet channels of working chambers V5 and V6;
104 inlet and outlet channels of working chambers V7 and V8;
201 inlet chamber V1;
202 outlet chamber V2;
203 working chamber V3;
204 working chamber V4;
205 working chamber V5;
206 working chamber V6;
207 working chamber V7;
208 working chamber V8;
301 gas channel A;
302 gas channel B;
303 gas channel C.

DETAILED DESCRIPTION OF THE INVENTION

The invention is an innovative solution on the basis of Chinese Patent No. ZL200610104569.8, Chinese Patent No. ZL200620079799.9 and Chinese Patent No. ZL200820028592.8, so as to improve the comprehensive capabilities of spherical expansion compressors while adapting them to variable working conditions. Therefore, above applications are incorporated herein by reference in their entirety.

The spherical expansion compressor according to the invention with a spherical inner chamber comprises:

a rolling rotor compressor used as first-stave compression, with an exhaust valve arranged at an outlet port thereof and a pressure-controlled inlet valve mounted at an inlet port thereof;

compression working chambers at least used as second-stage compression arranged in the spherical inner chamber;

expansion working chambers at least used as one-stage expansion arranged in the spherical inner chamber;

a gas tank, with the inlet port thereof in communication with the exhaust valve of the rolling rotor compressor and the outlet port thereof in communication with an inlet port of the second-stave compression of the spherical expansion compressor, for supplying gas sources of constant pressure to the gas suction of the second-stage compression of the spherical expansion compressor; and a pressure control circuit arranged between the gas tank and the pressure-controlled inlet valve, for controlling the pressure-controlled inlet valve to open/close according to the pressure state in the gas tank;

wherein when the pressure in the gas tank exceeds a set value, the pressure-controlled inlet valve is closed by the pressure control circuit, and when the pressure in the gas tank returns to the set value, the pressure-controlled inlet valve is opened and the rolling rotor compressor works normally. Working medium after the first-stage compression enters the gas tank, and the pressure in the tank is maintained constant substantially through regulation by the pressure control circuit. After entering the second-stave compression, the working medium of constant pressure is then expanded in an expansion stave, thereby forming the spherical expansion compressor adapted to variable working conditions.

The preferred embodiments of the invention shall be described with reference to the drawings, in which like reference numbers refer to like elements or elements of similar functions. In addition, "an embodiment" or "a particular embodiment" mentioned in the description means that a feature, a structure or a property described in relation to the particular embodiment is contained in at least one particular embodiment of the invention. "in a particular embodiment" or "a particular embodiment" appearing in different parts of the description does not necessarily refer to the same particular embodiment.

In addition, in the description, the principle of selecting words is for the convenience of reading and explanation, and is not intended to restrict or limit the object of the invention. Thus, the disclosure of the invention is for the sake of explanation, and is not for limiting the scope of the invention which is covered by the claims.

I. The First Embodiment

Figure 22:
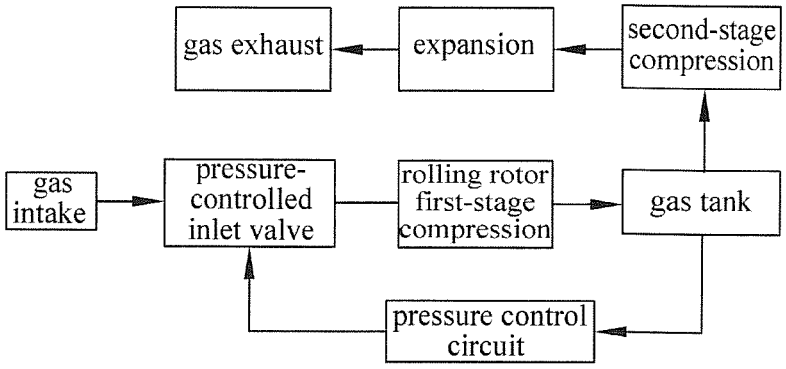
FIG. 22 is a block diagram of a structure realizing adjustment of variable working conditions.

The first embodiment adopts the first structure of the invention. FIG. 1 is a sectional view of the main structure of the first embodiment of the invention, and FIG. 22 is a block diagram of a structure realizing adjustment of variable working conditions. It can be seen from FIG. 1 that the compressor comprises a cylinder head 2, a cylinder 1, a piston 3, a rotary disk 5, a central pin 4, a main shaft 8, and a main shaft support 7, etc., and the cylinder 1 and the cylinder head 2 are connected by connecting screws 9 thereby forming a spherical inner chamber. The piston 3 has a spherical top face, with a piston shaft projecting through the center of the spherical top face. A piston pin seat is arranged at the lower part of the piston 3. There is a piston shaft hole corresponding to the piston shaft in the cylinder head 2, with the piston 3 being inserted into the piston shaft hole in a freely rotatable manner. The spherical top face of the piston 3 closely confronts said spherical inner chamber. There is a rotary disk pin seat corresponding to the piston pin seat at the upper part of the rotary disk. A rotary shaft projects downwards from the center of the lower end face of the rotary disk 5, and the spherical face of the rotary disk 5 closely confronts the spherical inner chamber. The piston hinge supports 10 are connected to the piston pin seat as a unit via positioning bolts 6 and nuts 21 (see FIG. 14), and forms a cylindrical hinge pair with the rotary disk pin seat in combination, with the central pin 4 inserted into a pin hole thereby forming a cylindrical hinge.

As shown in FIGS. 1-3 and 19-21, a rotor cylinder 13 of the rolling rotor compressor is arranged between the cylinder 1 and the main shaft support 7, and the main shaft support 7 and the rotor cylinder 13 are connected by the connecting screw 9 on the lower end of the cylinder 1. An inlet port 100 and an outlet port 101 are arranged on the rotor cylinder 13, and a sliding piece 14 and a sliding piece spring 15 are also mounted on the rotor cylinder 13, with the inlet port 100 directly opening to an annular wall and the outlet port 101 arranged opening to the main shaft support. A exhaust valve 16 and a valve limiter 17 are mounted on the outlet port 101, and the exhaust valve 16 and the valve limiter 17 are fixed on the lower part of the main shaft support 7 by a valve screw 18. Since the outlet port 101 is arranged on the main shaft support 7, the cylinder 1 is less likely to deform during operation, thereby increasing the hermeticity. The main shaft support 7, the main shaft hole in the cylinder 1 and the rotor cylinder 13 provide support for the rotation of the main shaft 8. A housing 19 is of a cylindrical shape, and its structure and shape matches the shapes of the rotor cylinder 13, a flange of the cylinder 1 and the main shaft support 7. A central line of a circle where the main shaft 8 matches the main shaft hole in the cylinder 1 coincides with the central line of the main shaft, whereas the axis of the part of the main shaft 8 corresponding to the rotor cylinder 13 does not coincide with the annular central line of the rotor cylinder 13, thereby an eccentric column is formed on the main shaft 8. The central line of the eccentric column is parallel with the central line of the main shaft 8, the eccentric column being tangential to the inner annulus of the rotor cylinder 13. The sliding piece 14 always closely confronts the outer circle of the eccentric column of the main shaft by the sliding piece spring 15. The main shaft 8 with the eccentric column is used as the rotor of the rolling rotor compressor, thereby forming a rolling rotor compressor between the main shaft support 7 and the cylinder 1, and an inlet chamber V1 201 and an outlet chamber V2 202 of the rolling rotor compressor are formed between the rotor cylinder 13 and the main shaft 8 when the main shaft 8 rotates.

The end of the main shaft 8 within the cylinder 1 has an eccentric shaft hole, the eccentric shaft hole matching the rotary disk shaft to form a cylindrical sliding bearing fit; and the other end is connected to a power mechanism for supplying power to vary the volume of the expansion compressor. The lower end of the piston 3 matches in shape the upper end of the rotary disk 5, and the piston pin seat matches the rotary disk pin seat. The piston 3 swings relative to the rotary disk 5 when the main shaft 8 rotates, and the spherical faces of the piston hinge supports, the spherical face of the rotary disk and the spherical top face of the piston form a hermetic running fit with the spherical inner chamber respectively, and the piston 3 and the rotary disk 5 are connected by a cylindrical hinge to form a hermetic running fit.

When the piston 3 and the rotary disk 5 swing relatively around the central pin 4, working chambers V7 207 and V8 208 whose volumes vary in an alternative manner are formed between the upper end face of the rotary disk 5, the lower end face of the piston 3, the planar end faces of the piston hinge supports 10 and the spherical inner chamber. However, since a through hole channel 11 communicating the working chamber V7 with working chamber V8 is arranged in the rotary disk, the working chambers V7 and V8 have no function of compression, thereby forming a non-compressed volume. Working chambers V3 203 and V4 204 whose volumes vary in an alternative manner are formed between a side of the slider 12, a side of the sector-shaped sliding channel and the planar end faces of the piston hinge supports 10. A sector-shaped bump of the annular body of the rotary disk pin seat swings in a sector-shaped cavity of the semicylindrical hole of the piston pin seat, and working chambers V5 205 and V6 206 whose volumes vary in an alternative manner are formed between a side of the sector-shaped bump, a side of the sector-shape cavity and the planar end faces of the piston hinge supports 10.

Figure 4:
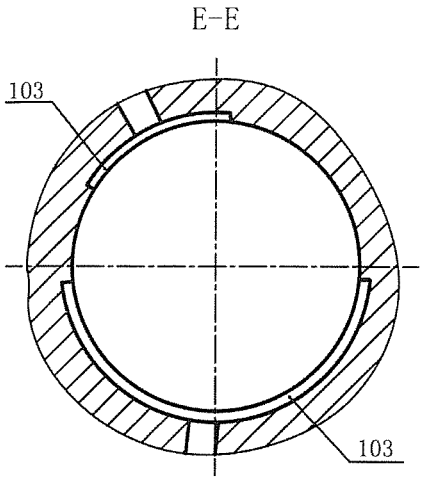
FIG. 4 is a sectional view taken along line E-E in FIG. 3.
Figure 5:
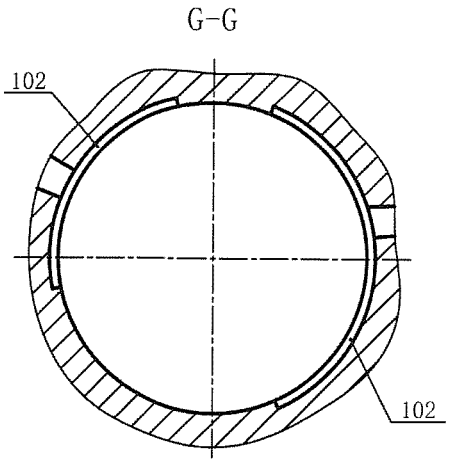
FIG. 5 is a sectional view taken along line G-G in FIG. 3.
Figure 3:
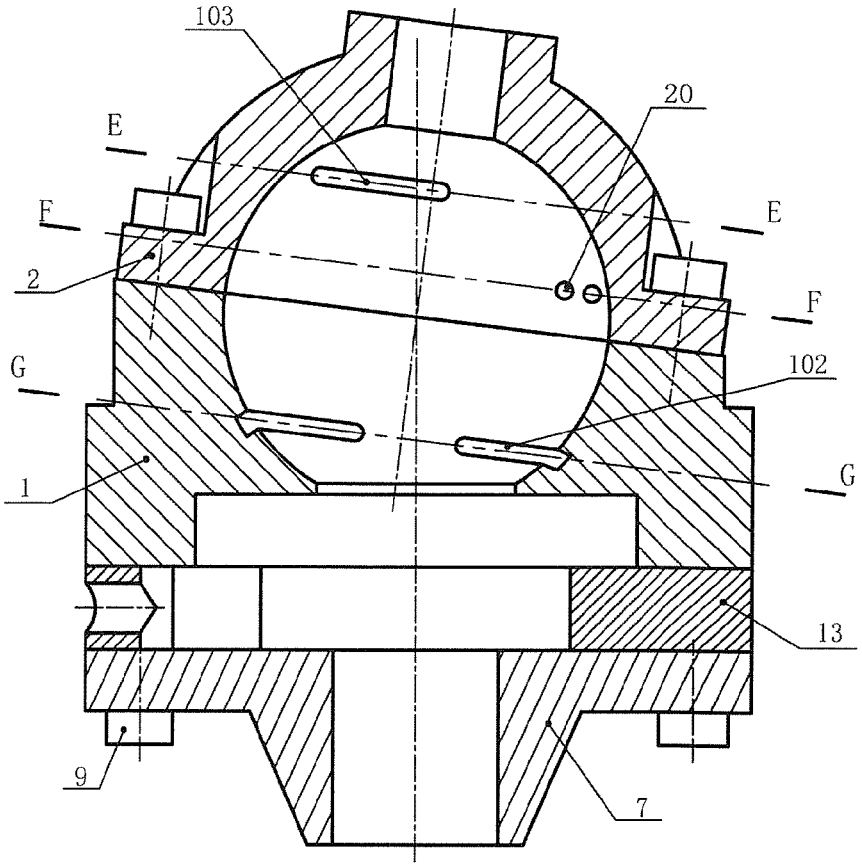
FIG. 3 is a sectional view of a housing of the first embodiment according to the invention.
Figure 6:
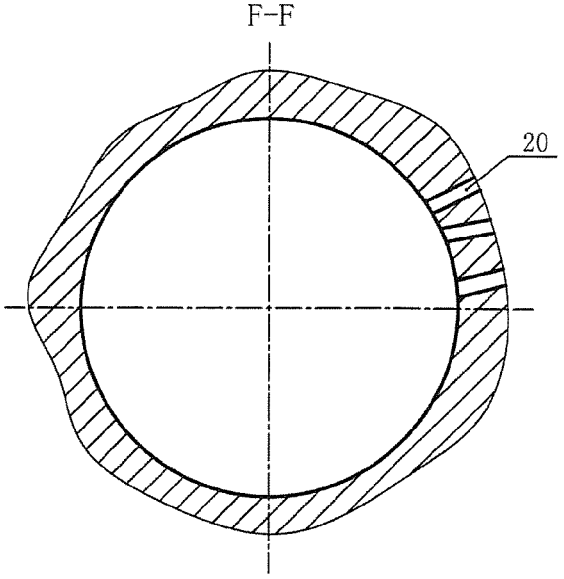
FIG. 6 is a sectional view taken along line F-F in FIG. 3.

As shown in FIG. 3, inlet and outlet channels for each of the working chambers are arranged in the spherical inner chamber formed by the cylinder 1 and the cylinder head 2, the inlet and outlet channels being arranged on the inner surface of the spherical inner chamber of the cylinder 1 and the cylinder head 2 and arranged within the annular space perpendicular to the axis of the piston and in communication with the outside of the cylinder. FIGS. 4-6 are sectional views taken along the lines E-E, G-G and F-F in FIG. 2 respectively. The F-F sectional view is a schematic diagram of the structure of drain holes 20 of the non-compressed working chamber V7 207 and the non-compressed working chamber V8 208. In this embodiment, since the working chambers V7 and V8 are of non-compressed volumes, they do not have inlet and outlet channels, and only cylinder head drain holes 20 are arranged in corresponding positions for discharging such substances as lubricant, etc. possibly accumulated in the non-compressed volumes. The E-E sectional view is a schematic diagram of the structure of inlet and outlet channels 103 of the working chamber V5 205 and the working chamber V6 206. The G-G sectional view is a schematic diagram of the structure of inlet and outlet channels 102 of the working chamber V3 203 and the working chamber V4 204.

Figure 7:
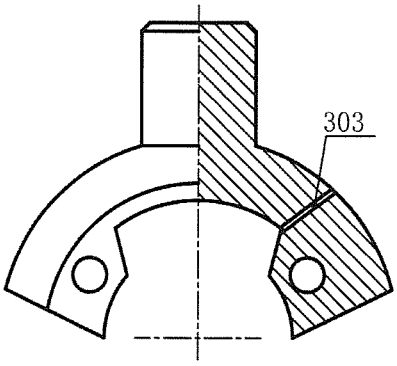
FIG. 7 is a front view of a piston of the first embodiment.
Figure 8:
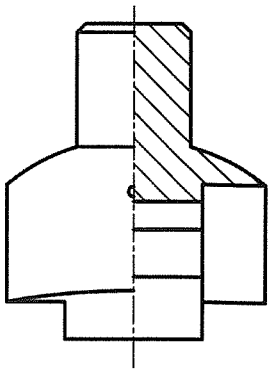
FIG. 8 is a left side view of the piston of the first embodiment shown in FIG. 7.

The piston 3 has a spherical top face, and a piston shaft projects from the center of the spherical top face, and there is a piston pin seat on the lower part of the piston 3, the piston pin seat being a semicylindrical hole formed at the lower end face of the piston opening downwards. There is a recessed sector-shaped cavity along the axial direction of the semicylindrical hole at the top of the inner circumference of the semicylindrical hole, the sector-shaped cavity running through along the axial direction of the semicylindrical hole and being sector-shaped on a section perpendicular to the axis of the semicylindrical hole. The axis of an semi-annular body is perpendicular to the piston shaft and passes through the spherical center of the spherical inner chamber. The two end faces of the semi-annular body are parallel planes, and the lower end face of the piston is a planar plane, as shown in FIGS. 7 and 8. FIG. 7 is a front view of the piston, and FIG. 8 is a left side view of the piston.

Figure 9:
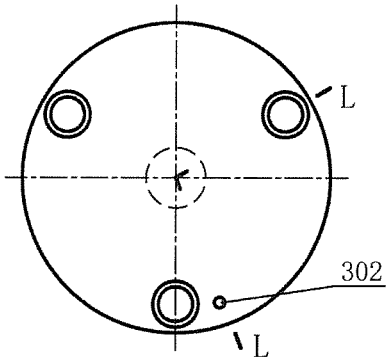
FIG. 9 is a front view of a piston hinge support of the first embodiment.
Figure 10:
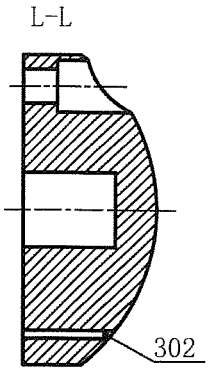
FIG. 10 is a left side view of the piston hinge support of the first embodiment shown in FIG. 9.

One end of the piston hinge support 10 is a plane, and the other end is a sphere, and the sphere matches the spherical inner chamber, and the shapes of the planar end face and sides of the piston hinge supports 10 match the structures of the two ends of the piston pin seat and the two ends of the rotary disk pin seat. There is a cylindrical pin hole at the center of the sphere coaxial with the semicylindrical hole of the piston pin seat, and the pin hole is a blind hole arranged at the center of the planar end of the piston hinge support, and the dimension of the cylindrical pin hole matches that of the central pin hole 4, as shown in FIGS. 9 and 10. FIG. 9 is a front view of the piston hinge support, and FIG. 10 is a left side view of the piston hinge support shown in FIG. 9.

Figure 13:
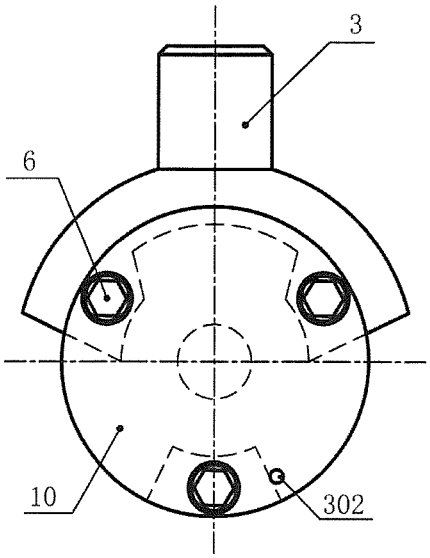
FIG. 13 is a front view of a combination of the piston and the piston hinge supports of the first embodiment.
Figure 14:
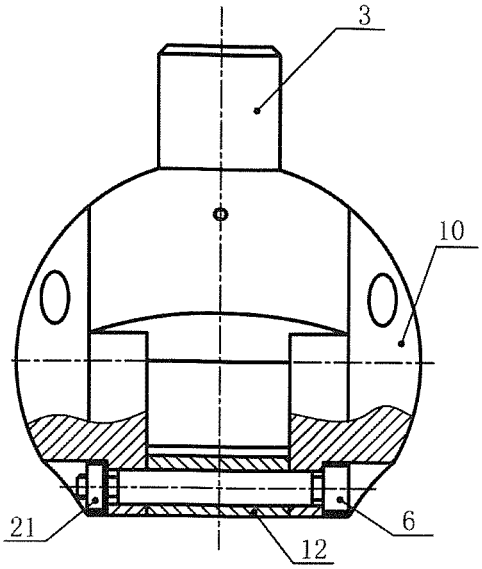
FIG. 14 is a left side view of the combination of the piston and the piston hinge supports of the first embodiment shown in FIG. 13.
Figure 18:
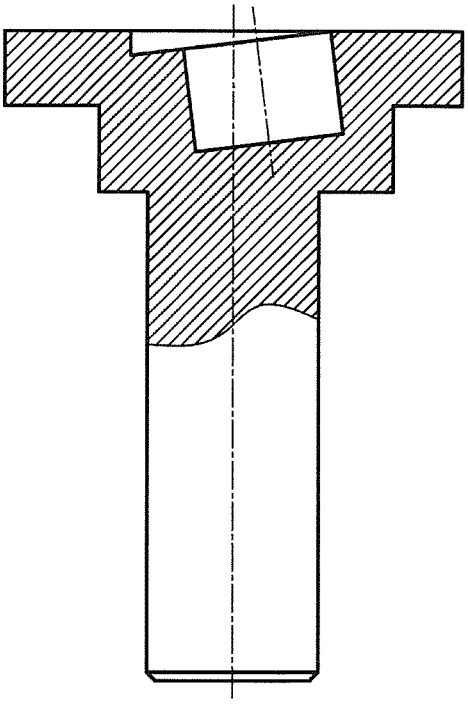
FIG. 18 is a front view of a main shaft.

There are holes for bolts therethrough in the piston 3, and the piston 3 and the piston hinge supports 10 are fixedly connected by the positioning bolts 6 and the nuts 21, and a sphere matching the spherical inner chamber are formed at the two outer ends of the piston pin seat and of the rotary disk pin seat. FIG. 13 is a front view of a combination of the piston and the piston hinge supports, and FIG. 14 is a left side view of the combination of the piston and the piston hinge supports shown in FIG. 13.

Figure 11:
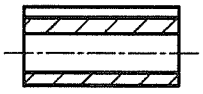
FIG. 11 is a front view of a slider.
Figure 12:
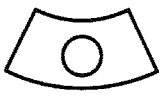
FIG. 12 is a left side view of the slider shown in FIG. 11.
Figure 15:
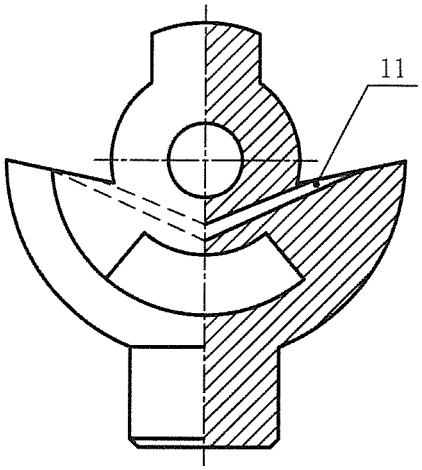
FIG. 15 is a front view of a rotary disk of the first embodiment.
Figure 16:
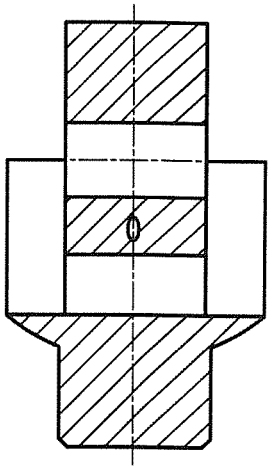
FIG. 16 is a left side view of the rotary disk of the first embodiment shown in FIG. 15.
Figure 17:
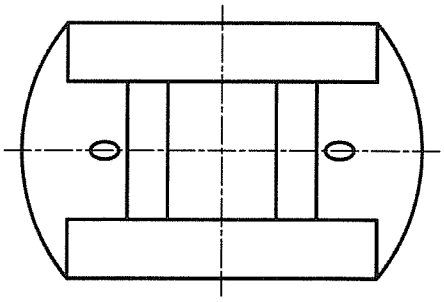
FIG. 17 is a top view of the rotary disk of the first embodiment shown in FIG. 15.
Figure 19:
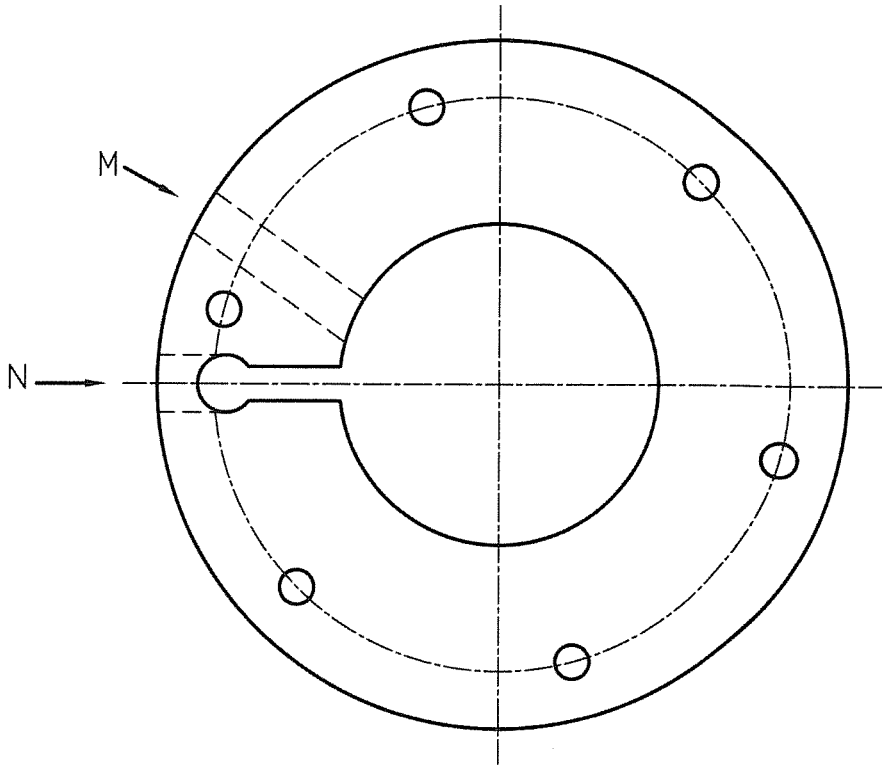
FIG. 19 is a front view of a rotor cylinder.
Figure 20:
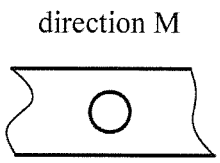
FIG. 20 is a view seen from direction M in FIG. 19.
Figure 21:
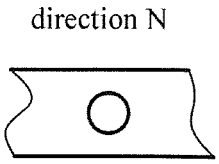
FIG. 21 is a view seen from direction N in FIG. 19.

FIG. 15 is a front view of the rotary disk, and FIG. 6 is a left side view of the rotary disk shown in FIG. 15, and FIG. 17 is a top view of the rotary disk shown in FIG. 15. A rotary disk shaft projects downwards from the center of the lower end face of the rotary disk 5, and a rotary disk pin seat matching the piston pin seat projects upwards from the upper end of the rotary disk 5. The rotary disk pin seat is an annular body, the axis of which is the same axis as the axis of said semicylindrical hole of the piston. A sector-shaped bump is formed outwardly along the axis of the annular body on the outer circumference of the annular body of the rotary disk pin seat. The sector-shaped bump passes through along the axial direction of the rotary disk pin seat, and is sector-shaped on the circumferential face which matches the sector-shaped cavity of the piston pin seat and has the same center of the sector-shape as that of the piston pin seat. The outer circle of the annular body of the rotary disk pin seat matches the inner circle of the semicylindrical hole of the piston pin seat thereby forming a hermetic running fit. The inner circle of the annular body of the rotary disk pin seat matches the central pin 4 thereby forming a hermetic running fit, and the sphere of the rotary disk closely confronts the spherical cavity and has the same spherical center. The upper end face of the rotary disk 5 is a planar plane, and the shape of the lower part of the piston 3 matches the shape of the upper part of the rotary disk 5. A through hole channel 11 is arranged in the rotary disk, and the inlet and outlet of the through hole channel 11 are respectively located at the two sides of the rotary disk pin seat on the upper end face of the rotary disk 5 and run through inside the rotary disk 5. There is a sector-shaped sliding channel at the lower part of the annular body of the rotary disk pin seat, and the sector-shaped sliding channel runs through in the axial direction of the annular body, and the axis of the sector-shaped sliding channel being parallel with the axis of the annular body. The shape of the slider 12 matches the shape of the sector-shaped sliding channel, and the slider 12 is freely slidable in the sliding channel, and the two end faces of the slider 12 closely confronts the planar end faces of the piston hinge supports 10 and they are fixedly connected by the positioning bolts 6. FIGS. 11 and 12 are diagrams of the structure of the slider, wherein FIG. 11 is a front view of the slider, and FIG. 12 is a left side view of the slider shown in FIG. 11, and the cross section of the slider 12 is sector-shaped, and there are holes in the slider for bolts therethrough.

The piston hinge supports 10 match the shapes of the two ends of the piston pin seat and of the rotary disk pin seat, and hermetic running fits are formed between the piston hinge supports 10 and the spherical inner chamber and between the piston hinge supports 10 and the rotary disk pin seat.

As shown FIGS. 7, 9, 10 and 13, the working chambers V7 207 and V8 208 are of non-compressed volumes due to opening to the through hole channel 11 and thus have no gas channels; the gas channel of the working chambers V3 203 and V4 204 is gas channel B 302 which is arranged in the piston hinge support 10, and the gas channel of the working chambers V5 205 and V6 206 is gas channel C 303 which is arranged in the piston 3.

As shown in FIG. 22, the inlet port of the rolling rotor compressor is connected to a pressure-controlled inlet valve, and a compressed working medium (such as gaseous carbon dioxide) enters an inlet chamber V1 201 of the rolling rotor compressor via the pressure-controlled inlet valve, and is transported to the gas tank by an outlet chamber V2 202 after first-stage compression. Since the working condition of worst displacement of the capacity of the rolling rotor compressor is taken into consideration in design, when the actual working condition deviates from the designed working condition, the rolling rotor compressor continuously delivers excess gas to the gas tank, and the pressure inside the tank will be increased. A pressure-controlled circuit is arranged between the gas tank and the pressure-controlled inlet valve. When the pressure in the gas tank exceeds a set value in case of variable working conditions, a slight pressure difference is set and is used to control the pressure-controlled inlet valve, such that the pressure-controlled inlet valve is closed. At this moment, the rolling rotor compressor runs idle (wasting no compression work). And when the pressure in the gas tank falls to a normal value, the pressure-controlled inlet valve is opened again and gas is taken in normally, so that the pressure in the gas tank reaches a substantially constant value and realizes an application of variable working conditions.

In the rolling rotor compressor, the inlet chamber V1 201 and the outlet chamber V2 202 are used as first-stage compression, the working chamber V3 203 and the working chamber V4 204 are used as second-stage compression, and the working chamber V5 205 and the working chamber V6 206 are used for expansion. The working medium enters into the gas tank after the first-stage compression and is controlled by the pressure-controlled circuit, such that the pressure in the gas tank is maintained substantially constant. After entering the second-stage compression, the working medium of constant pressure is expanded at the expansion stage, and the rolling rotor compressor is applicable as the spherical expansion compressor of second-stage compression and one-stage expansion of $CO_2$ circulation in variable working conditions.

II. The Second Embodiment

The second embodiment adopts the second structure of the invention. The differences between the second embodiment and the first embodiment exist in: in the second embodiment, there is no sector-shaped sliding channel at the lower part of the annular body of the rotary disk pin seat, and no slider is formed, and a working chamber is not constituted by a slider and a sector-shaped sliding channel, instead a supporting bushing is not in contact with the arcuate opening at the lower part of the annular body of the rotary disk pin seat, and there is no gas channel B 302 at the piston hinge support, and there is no corresponding inlet and outlet channels 102 in the cylinder, and a rotary disk drain hole is arranged in the rotary disk; no through hole channel 11 communicating the working chambers V7 207 and V8 208 is arranged in the rotary disk, and the working chambers V7 207 and V8 208 form a pair of compressible spaces, and gas channels and guiding slots of the working chambers V7 207 and V8 208 are arranged in the piston, and the inlet and outlet channels of the working chambers V7 207 and V8 208 are arranged in the cylinder head; the lower end face of the piston is at a position below the spherical center of the upper spherical surface of the piston, and planes matching the lower end face of the piston are formed at the two sides of the rotary disk pin seat. In the second embodiment, other parts and the connecting manner of the parts are the same as those in the first embodiment, except that the cylinder head, the cylinder, the piston and rotary disk are different in structure from those in the first embodiment. For distinguishing the parts from those in the first embodiment, the cylinder head, the cylinder, the piston, the rotary disk and the piston hinge supports in the second embodiment are referred to as a cylinder head II, a cylinder II, a piston II, a rotary disk II, and piston hinge supports II.

Figure 23:
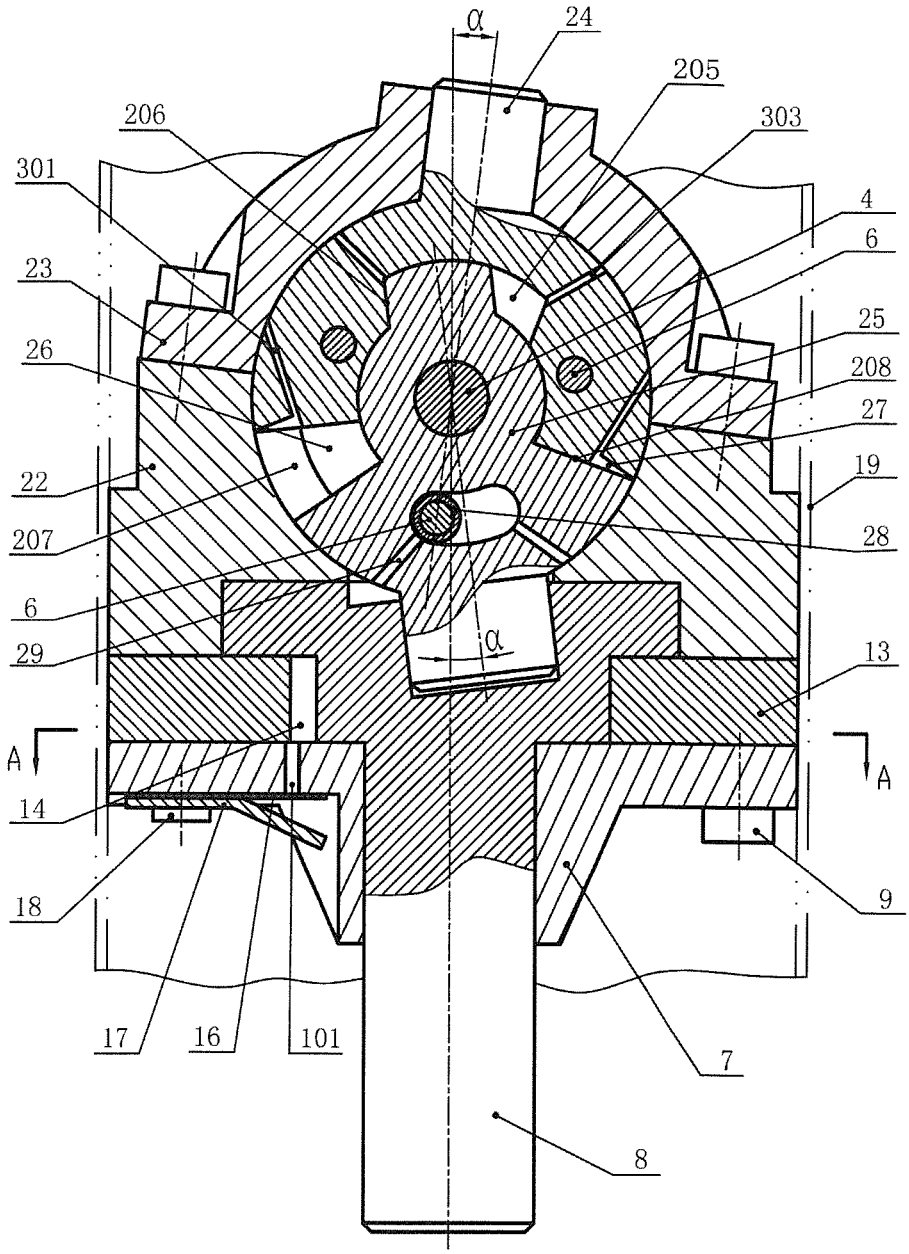
FIG. 23 is a sectional view of a structure of the second embodiment.

FIG. 23 is a sectional view of the structure of the second embodiment. The compressor according to the second embodiment comprises a cylinder head II 23, a cylinder II 22, a piston II 24, a rotary disk II 25, and central pin 4, a main shaft 8, and a main shaft support 7, etc., and the cylinder II 22 and the cylinder head II 23 are connected by a connecting screw 9 thereby forming a spherical inner chamber. The piston II 24 has a spherical top face, and a piston shaft projects from the center of the spherical top face, and a piston pin seat is at the lower part of the piston II 24, and a piston shaft hole corresponding to the piston shaft is arranged in the cylinder head II 23. The piston II 24 is inserted into the piston shaft hole in a freely rotatable manner, and the spherical top face of the piston II 24 closely confronts said spherical inner chamber. A rotary disk pin seat corresponding to the piston pin seat is arranged at the upper part of the rotary disk II 25. A rotary shaft projects downwards from the center of the lower end face of the rotary disk II 25, and the spherical face of the rotary disk II 25 closely confronts the spherical inner chamber. The piston hinge supports II 26 are connected to the piston pin seat by positioning bolts 6 and a nuts 21 as a unit (see FIG. 32), and the piston hinge supports II 26 are assembled with the rotary disk pin seat thereby forming a cylindrical hinge pair. The central pin 4 is inserted into a pin hole, thereby forming a cylindrical hinge having spherical end faces at two ends thereof.

The rolling rotor compressor is identical to that of the first embodiment and is shown in FIGS. 23, 2, 3, 19, 20 and 21. A rotor cylinder 13 of the rolling rotor compressor is arranged between the cylinder II 22 and the main shaft support 7, and the main shaft support 7 and the rotor cylinder 13 are connected to the lower end of the cylinder II 22 by the connecting screws 9. An inlet port 100 and an outlet port 101 are arranged on the rotor cylinder 13, and a sliding piece 14 and a sliding piece spring 15 are also mounted on the rotor cylinder 13, and the inlet port 100 is directly opening on an annular wall, and the outlet port 101 is opening in the main shaft support. A exhaust valve 16 and a valve limiter 17 are mounted on the outlet port 101, and the exhaust valve 16 and the valve limiter 17 are fixed to the lower part of the main shaft support 7 by a valve screw 18. Since the outlet port 101 is arranged on the main shaft support 7, the cylinder II 22 is less likely to deform during operation, thereby increasing hermeticity. The main shaft support 7, the main shaft hole in the cylinder II 22 and the rotor cylinder 13 provide support for the rotation of the main shaft 8. A housing 19 is of a cylindrical shape, and its structure matches the shapes of the rotor cylinder 13, a flange of the cylinder II 22 and the main shaft support 7. A central line of a circle of the location where the main shaft 8 matches the main shaft hole in the cylinder II 22 coincides with the central line of the main shaft, the axis of the part of the main shaft 8 corresponding to the rotor cylinder 13 does not coincide with the annular central line of the rotor cylinder 13. An eccentric column is formed on the main shaft 8, and the central line of the eccentric column is parallel with the central line of the main shaft 8, and the eccentric column is tangential to the inner annulus of the rotor cylinder 13. The sliding piece 14 always closely confronts to the outer circle of the eccentric column of the main shaft by the sliding piece spring 15. The main shaft 8 with the eccentric column is used as the rotor of the rolling rotor compressor, and the rolling rotor compressor is formed between the main shaft support 7 and the cylinder II 22, and an inlet chamber V1 201 and an outlet chamber V2 202 of the rolling rotor compressor are formed between the rotor cylinder 13 and the main shaft 8 when the main shaft 8 rotates.

The end of the main shaft 8 within the cylinder II 22 has an eccentric shaft hole, and the eccentric shaft hole matches the rotary disk shaft to form a cylindrical sliding bearing fit, and the other end is connected to a power mechanism for supplying power to vary the volume of the expansion compressor. The lower end of the piston II 24 matches in shape the upper end of the rotary disk II 25, and the piston pin seat matches the rotary disk pin seat, and when the main shaft 8 rotates, the piston II 24 swings relative to the rotary disk II 25, the two end faces of the cylindrical hinge, the spherical face of the rotary disk and the spherical top face of the piston form a hermetic running fit with the spherical inner chamber respectively, and the piston II 24 and the rotary disk II 25 are connected by the cylindrical hinge to form a hermetic running fit.

When the piston II 24 and the rotary disk II 25 swing relatively around the central pin 4, working chambers V7 207 and V8 208 whose volumes vary in an alternative manner are formed between the upper end face of the rotary disk II 25, the lower end face of the piston II 24, the planar end faces of a piston hinge supports II 26 and the spherical inner chamber. A sector-shaped bump of the annular body of the rotary disk pin seat swings in a sector-shaped cavity of the semicylindrical hole of the piston pin seat, and working chambers V5 205 and V6 206 whose volumes vary in an alternative manner are formed between a side of the sector-shaped bump, a side of the sector-shape cavity and the planar end faces of the piston hinge supports II 26.

Figure 24:
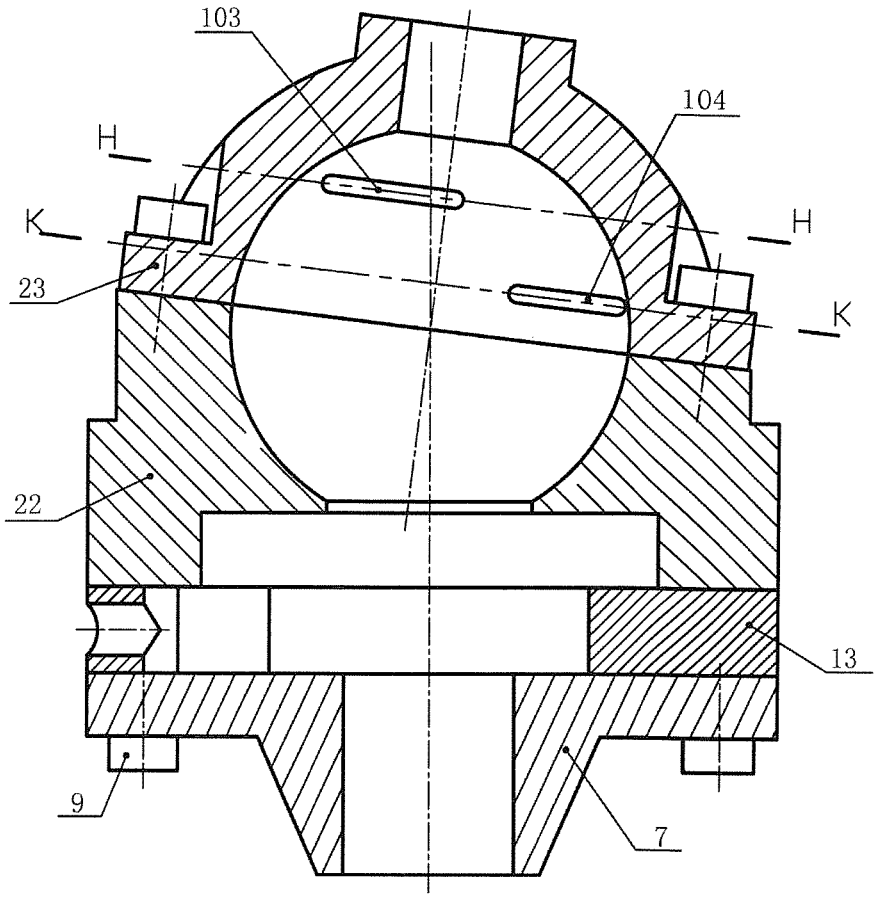
FIG. 24 is a sectional view of a housing of the second embodiment.
Figure 25:
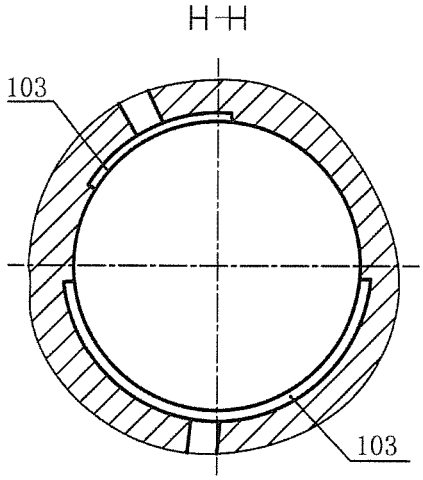
FIG. 25 is a sectional view taken along line H-H in FIG. 24.
Figure 26:
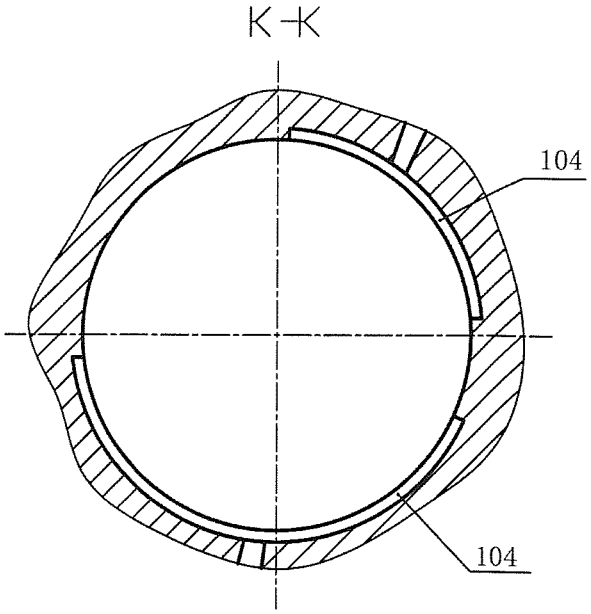
FIG. 26 is a sectional view taken along line K-K in FIG. 24.

The inlet and outlet channels 104 of the working chambers V7 207 and V8 208 and the inlet and outlet channels 103 of the working chambers V5 205 and V6 206 are arranged on the inner surface of the spherical inner chamber formed by the cylinder II 22 and the cylinder head II 23 and arranged within the annular space perpendicular to the axis of the piston and in communication with the outside of the cylinder, as shown in FIGS. 24, 26 and 25. The K-K cross section is a schematic diagram of the structure of the inlet and outlet channels 104 of the working chambers V7 207 and V8 208, and the H-H cross section is a schematic diagram of the structure of the inlet and outlet channels 103 of the working chambers V5 205 and V6 206.

Figure 27:
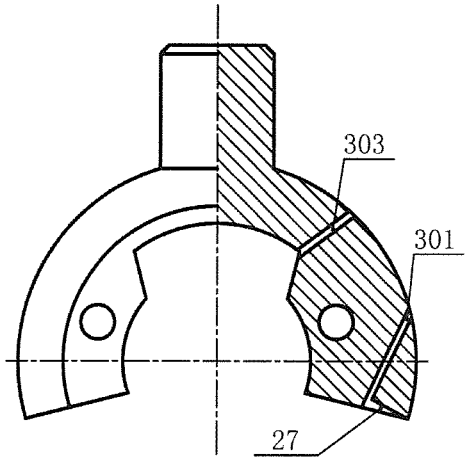
FIG. 27 is a front view of a piston of the second embodiment.
Figure 28:
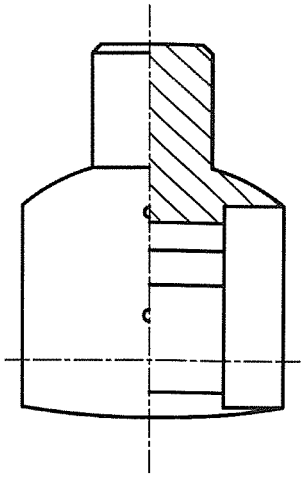
FIG. 28 is a left side view of the piston of the second embodiment shown in FIG. 27.

Reference is made to FIGS. 27 and 28 for the structure of the piston in the second embodiment, wherein FIG. 27 is a front view of the piston, and FIG. 28 is a left side view of the piston shown in FIG. 27. The piston II 24 has a spherical top face, and a piston shaft projects from the center of the spherical top face, and there is a piston pin seat at the lower part of the piston II 24, and the piston pin seat is a semicylindrical hole formed at the lower end face of the piston opening downwards. There is a recessed sector-shaped cavity along the axial direction of the semicylindrical hole at the top of the inner circumference of the semicylindrical hole, and the sector-shaped cavity passes through in the axial direction of the semicylindrical hole and is sector-shaped on a section perpendicular to the axis of the semicylindrical hole. The axis of an semi-annular body is perpendicular to the piston shaft and passes through the spherical center of the spherical inner chamber. The two end faces of the semi-annular body are parallel planes; the lower end face of the piston is a planar plane which is at a position below the spherical center of the upper spherical surface of the piston. The gas channels of the working chambers V7 207 and V8 208 are arranged within the piston II 24, and one end of the gas channel is on the spherical face of the piston, and the other end is on the lower end face of the piston and in communication with a guiding slot 27 arranged in the lower end face and close to the spherical face. The function of the guiding slot 27 is to prevent liquid strike.

Figure 29:
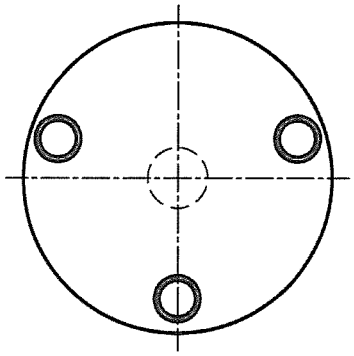
FIG. 29 is a front view of a piston hinge support of the second embodiment.
Figure 30:
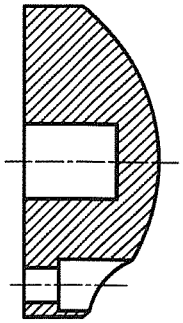
FIG. 30 is a left side view of the piston hinge support of the second embodiment shown in FIG. 29.

Reference is made to FIGS. 29 and 30 for the structure of the piston hinge support in the second embodiment, wherein FIG. 29 is a front view of the piston hinge support, and FIG. 30 is a left side view of the piston hinge support shown in FIG. 29. One end of the piston hinge support II 26 is a planar plane, and the other end is a sphere. The sphere matches the spherical inner chamber, and the shapes of the planar end faces and sides of the piston hinge supports II 26 match the structures of the two ends of the piston pin seat and the two ends of the rotary disk pin seat. There is a cylindrical pin hole coaxial with the semicylindrical hole of the piston pin seat at the center of the sphere, and the pin hole is a blind hole arranged at the center of the planar end face of the piston hinge support, and the cylindrical pin hole matches the size of the central pin hole 4. In comparison with the first embodiment, no gas channel 302 is arranged in the piston hinge support II 26 in this embodiment, and the positions of the screw through holes for the positioning bolts 6 change and are no longer uniformly distributed.

Figure 31:
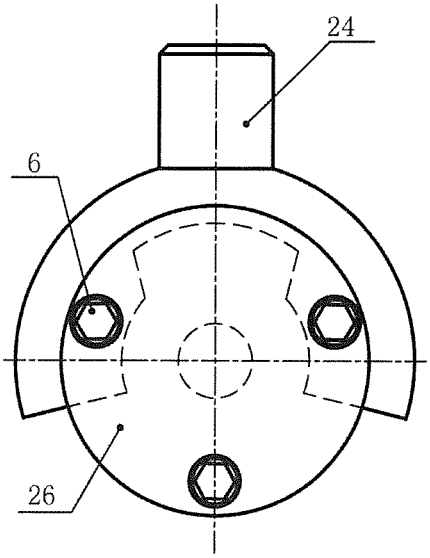
FIG. 31 is a front view of a combination of the piston and the piston hinge supports of the second embodiment.
Figure 32:
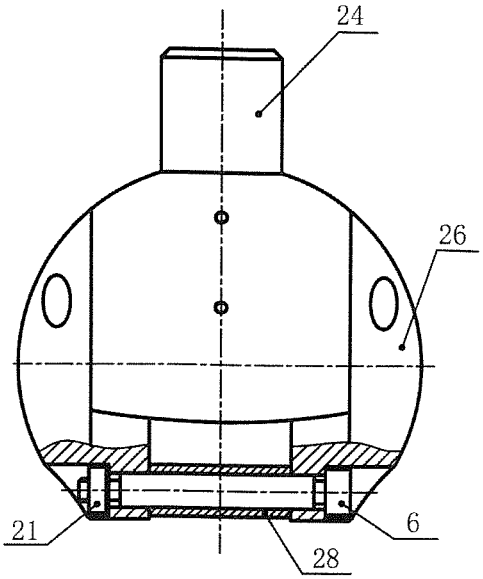
FIG. 32 is a left side view of the combination of the piston and the piston hinge supports of the second embodiment shown in FIG. 31.

The piston II 24 and the piston hinge supports II 26 are fixedly connected by the positioning bolts 6 and the nuts 21, and a supporting bushing 28 is supported between two piston hinge supports II 26, and the two piston hinge supports II 26 are connected and fixed by the positioning bolts 6 and the nuts 21. FIG. 31 is a front view of a combination of the piston and the piston hinge supports, and FIG. 32 is a left side view of the combination of the piston and the piston hinge supports shown in FIG. 31.

Figure 33:
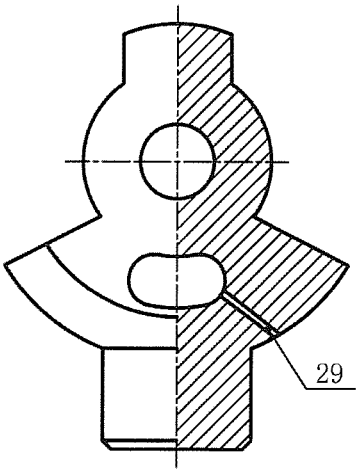
FIG. 33 is a front view of the rotary disk of the second embodiment.
Figure 34:
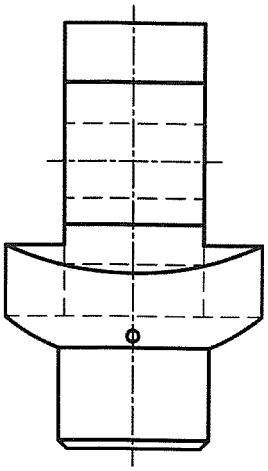
FIG. 34 is a left side view of the rotary disk of the second embodiment shown in FIG. 33.

FIG. 33 is a front view of the rotary disk, and FIG. 34 is a left side view of the rotary disk shown in FIG. 33. A rotary disk shaft projects downwards from the center of the lower end face of the rotary disk II 25, and the rotary disk pin seat matching the piston pin seat projects upwards from the upper end. The rotary disk pin seat is an annular body whose axis is the same axis as that of said semicylindrical hole of the piston. A sector-shaped bump is formed along the axial direction of the annular body on the outer circumference of the annular body of the rotary disk pin seat, and the sector-shaped bump runs through along the axial direction of the rotary disk pin seat. The sector-shaped bump is sector-shaped on the circumferential face and matches the sector-shaped cavity of the piston pin seat and has the same center of sector as that of the piston pin seat. The outer circle of the annular body of the rotary disk pin seat matches the inner circle of the semicylindrical hole of the piston pin seat thereby forming a hermetic running fit. The inner circle of the annular body of the rotary disk pin seat matches the central pin 4 to reach a hermetic running fit, and the sphere of the rotary disk closely confronts to the spherical cavity and has the same spherical center. The upper end face of the rotary disk II 25 is a planar plane, and a plane matching the lower end face of the piston II 24 is formed at the two sides of the rotary disk pin seat. There is an arcuate opening at the lower part of the annular body of the rotary disk pin seat of the rotary disk II 25. The upper and lower arcs of the arcuate opening are concentric arcs, and the two sides are semicircular, and the arcuate opening is run through along the axial direction of the annular body of the rotary disk pin seat of the rotary disk II 25. The supporting bushing 28 is a cylinder with through hole for bolt therethrough in the center thereof, and the supporting bushing 28 is movable in the arcuate opening. The two end faces of the cylinder of the supporting bushing 28 closely confront planar end faces of the piston hinge supports II 26 and are fixedly connected by the positioning bolts 6 and the nuts. The supporting bushing 28 moves in the arcuate opening when the piston II 24 swings around the central pin 4 relative to the rotary disk II 25, thereby strengthening the rigidity of the connection of the piston II 24 and the piston hinge supports II 26 and improving the effect of hermeticity. A rotary disk drain hole 29 is arranged in the rotary disk II 25, which communicates the lower part of the arcuate opening and the root of the lower end of the sphere of the rotary disk, thereby discharging the liquid possibly accumulated in the inner chamber of the arcuate opening and preventing liquid strike.

The gas channel of the working chambers V7 207 and V8 208 is gas channel A 301, and the gas channel of the working chambers V5 205 and V6 206 is gas channel C 303, and both the gas channel A 301 and the gas channel C 303 are arranged in the piston II 24.

The structure of the rolling rotor compressor of the second embodiment realizing the adjustment of variable working conditions is identical to that of the first embodiment, as shown in FIG. 22.

In the rolling rotor compressor, the inlet chamber V1 201 and the outlet chamber V2 202 are used as first-stage compression, the working chamber V7 207 and the working chamber V8 208 are used as second-stage compression, and the working chamber V5 205 and the working chamber V6 206 are used for expansion; the working medium after the first-stage compression enters the gas tank, and is controlled by the pressure-controlled circuit, such that the pressure in the gas tank is maintained substantially constant; after entering the second-stage compression, the working medium of constant pressure is expanded at the expansion stage, and the rolling rotor compressor is applicable as the spherical expansion compressor of second-stage compression and one-stage expansion of $CO_2$ circulation in variable working conditions.

The common features of the two embodiments are as follows:

(I) the working chambers V7 207, V3 203 and V5 205 are in the state of maximum allowable volumes in the cross sectional views of structures of the first embodiment, and the working chambers V8 208, V4 204 and V6 206 are in the state of minimum allowable volumes in the cross sectional views of structures of the embodiments;

(II) the axes of the piston shaft, of the rotary disk shaft and of the main shaft 8 all pass through the spherical center of the spherical inner chamber, and the axes of the piston shaft and of the rotary disk shaft form identical angles $\alpha$ with respect to the axis of the main shaft 8, with an optimal range of $\alpha$ being 5°-15°;

(III) the moment of inertia of the piston around the axis of the piston is close to or equals to the moment of inertia of the rotary disk around the axis of the rotary disk; it has been found in further studies that if the main shaft in the spherical compressor rotates at an uniform speed, the speeds of rotation of the piston and the rotary disk around themselves are not uniform; such nonuniform rotation will cause a problem of bringing inertia moments, and the inertia moments will finally be transferred to the main shaft, generating torque fluctuation on the main shaft, thereby causing torque vibration and noise and resulting in the decrease of the efficiency of the motor. The inventors of the invention have derived a formula for calculating the combined result of the inertia moments acted on the main shaft generated by the nonuniform rotation of the piston and the rotary disk:

$$M = \frac{\cos\alpha \cdot \sin^2\alpha \cdot \sin\theta \cdot \omega_\theta^2}{[\cos^2\alpha(1+\cos\theta)+(1-\cos\theta)]^2} \cdot [J_H - J_P]$$

where,

M represents the combined torque of the inertia moments acted on the main shaft;

$\omega_\theta$ represents the speed of rotation of the main shaft in uniform speed movement;

$\alpha$ represents the included angle of the axes of piston and of the rotary disk with respect to the axis of the main shaft;

$\theta$ represents the angle of rotation of the main shaft;

$J_H$ represents the rotational inertia of the piston around its axis; and $J_P$ represents the rotational inertia of the rotary disk around its axis.

It can be seen from the above formula that the closer the values of $J_H$ and $J_P$, the smaller the value of M is, and when values of $J_H$ and $J_P$ are equal, the value of M is zero. An important conclusion may be made that in the design of the structures of the piston and the rotary disk, it should be taken into consideration that the rotational inertia of the piston and the rotational inertia of the rotary disk should be close or equal. In this way, the effect of inertia moments on the main shaft may be reduced, which may prevent torque vibration, reduce noise and improve the efficiency of the motor, and is quite advantageous for high-speed variable-frequency working conditions.

(IV) the arrangement of the parting faces of the cylinder head and the cylinder on the plane which is perpendicular to the piston shaft and passes through the spherical center of the spherical inner chamber is convenient for machining and assembly;

(V) the main shaft 8 rotates clockwise when viewed along the direction of the main shaft 8 from the cylinder head;

(VI) the order of assembly of the cylindrical hinge is as follows: first connect the piston pin seat and the rotary disk pin seat by use of the central pin 4; and then connect the piston hinge supports at the two ends of the piston pin seat via the positioning bolts 6 and nuts 21 after the slider and the supporting bushing is mounted; after the piston and the piston hinge supports are assembled and placed in the spherical cylinder, a void volume is formed between the inner hexagonal head of the positioning bolts 6, the connecting nut 21, the corresponding through hole in the piston hinge supports and the spherical inner chamber, and the working media and lubricants will accumulate in the void volume. Therefore, a specific process must be provided after the piston and the piston hinge supports are assembled and before they are placed in the spherical cylinder, i.e., using a suitable material, or preparing specific blocks to fill the void volume. At the same time, it is required that when the compressor is in operation, the filling and the blocks should not cause a large frictional power consumption between them and the inner surface of the spherical inner chamber;

(VII) in the embodiments, the lubricant may be introduced through the main shaft, and exits from the piston shaft, and may be introduced through the piston shaft and exits from the main shaft; and (VIII) taking comprehensively hermeticity, vibration, mechanical friction and working capabilities into consideration, the optimal cylinder diameter of the spherical inner chamber of the invention is 40-150 millimeters.

The structure of the invention possesses the prominent substantive features and represents a notable progress over Chinese Patent No. ZL200610104569.8, Chinese Patent No. ZL200620079799.9 and Chinese Patent No. ZL200820028592.8 as follows, (I) an optimal range of value of the angle $\alpha$ of the axes of the piston shaft and of the rotary disk shaft with respect to the axis of the main shaft is determined as 5°-15° in the invention, since the size of angle $\alpha$ relates to the discharge capacity, vibration and effect of hermeticity of the spherical expansion compressor. The greater the value of the angle $\alpha$, the larger the discharge capacity is; however, the effect of hermeticity and vibration deformation are bad. On the contrary, the discharge capacity decreases, resulting in structural waste. After further studies, an optimal range of value of the angle $\alpha$ is given in the invention, and within this range, the spherical expansion compressor is comprehensively optimized with respect to such as discharge capacity, hermeticity, and vibration, etc., thereby providing a foundation for the excellent performance of the whole machine;

(II) in Chinese Patent No. ZL200610104569.8, Chinese Patent No. ZL200620079799.9 and Chinese Patent No. ZL200820028592.8, the rotary disk shaft and the main shaft are connected by a spherical bearing. Such a structure uses the advantage that its axis may swing, which is well adapted to the tolerances in machining and is robust in structure; however, it has a disadvantage of increasing the cost of manufacture. It has been found that in condition that the precision of production has reached a micron level currently, the function of the spherical bearing has been lessened; hence, in the invention, a structure is proposed where the spherical bearing is omitted. At this moment, the rotary disk shaft and the main shaft 8 may be directly connected in a form of a shaft-hole pair, thereby forming a cylindrical sliding bearing fit. Such improvement simplifies the structure and lowers the cost, which is particularly significant when producing compressors in large scale;

(III) the pin hole of the piston hinge support is changed from a through hole into a blind hole, which is advantageous for strengthening of hermeticity. The width of the hermetic face is increased, and the leakage is reduced; and at the same time, changing the positioning screws in the piston assembly into positioning bolts reduces the deformation of the slider, increases the rigidity of the assembly, and improves the hermetic capability;

(IV) the function of two-stage compression and one-stage expansion of $CO_2$ working medium under variable working conditions is realized; and since the feature that the pressure of the rolling rotor compressor is constant is used and a control system is equipped, the whole machine possesses a capability of working condition variation;

(V) it has been found in further studies that if the main shaft in the spherical compressor rotates at an uniform speed, the speeds of rotation of the piston and of the rotary disk around themselves are not uniform; such nonuniform rotation will bring a problem of inertia moments, and the inertia moments will finally be transferred to the main shaft, generating torque fluctuation on the main shaft, thereby causing torque vibration and noise and resulting in the decrease of the efficiency of the motor in a severe situation. It should be taken into consideration in the design of the structures of the piston and the rotary disk that the rotational inertia of the piston and the rotational inertia of the rotary disk should be close or equal. In this way, the effect of inertia moments on the main shaft may be reduced, which may prevent torque vibration, reduce noise and improve the efficiency of the motor, and is quite advantageous for high-speed variable-frequency working conditions.

(VI) in the second embodiment, the function of the piston is very important; however, in Chinese Patent No. ZL200610104569.8, Chinese Patent No. ZL200620079799.9 and Chinese Patent No. ZL200820028592.8, there is no requirement on the particular shape of the lower end face of the piston; it has been found in further studies that the structure form of the lower end face of the piston II 24 has great influence on the working chambers V7 207 and V8 208. The structure form of the lower end face of the piston II 24 proposed in the invention is: the lower end face of the piston II 24 is a planar plane, and the planar plane is at a position below the spherical center of the upper spherical surface of the piston II 24, with a minimum distance h to the spherical center, and distance h is greater than 1 millimeter at least. The design of the upper end face of the rotary disk II 25 is based on the lower end face of the piston II 24 and matches thereto, so as to ensure the completion of the function of compression; the advantage of such a structure exists in that the joint of the parting faces of the cylinder II 22 and the cylinder head II 23 is not located within the working chambers V7 207 and V8 208, thereby reducing leakage brought by the clearance of the joint of the parting faces;

(VII) in the second embodiment, the gas channel 301 of the working chambers V7 207 and V8 208 is arranged inside the piston, with one end of the gas channel being on the spherical surface of the piston, and the other end being on the lower end face of the piston and being in communication with the guiding slot 27 which is arranged on the lower end face and is close to the outer peripheries of the working chambers. In order to reduce leakage, the gas channel 301 is arranged in an embedded manner, rather than arranged on the surface of the piston, and a guiding slot 27 is arranged on one end of the working chambers. The function of arranging the guiding slot is that, when the piston rotates, if there is liquid (such as a lubricant) in the working chambers, the liquid will be accumulated at the outer peripheries of the working chambers due to the centrifugal action; and if there is no guiding slot, the liquid is not easy to be discharged, resulting in "liquid strike";

hence, a guiding slot should be added, which is in communication with the gas channel, such that the liquid is successfully discharged. The corresponding gas channel 301 in the above mentioned patents is exposed to the parting face of the sphere, which is likely to leak under a high pressure; and (VIII) in the first embodiment, the working chambers V7 207 and V8 208 are connected by a through hole channel, such that they do not have a function of compressing, thereby forming a non-compressed volume; and since one-stage compression is omitted, there are only two groups of inlet and outlet channels in the spherical inner chamber, so there are more spaces for arrangement, thereby increasing the widths of the hermetic faces of the inlet and outlet channels, reducing the leakage, and improving the hermeticity.

Although particular embodiments and applications thereof of the present invention are described herein, it should be understood that the invention is not limited to the particular configurations and elements as described herein, and various modifications, variations and changes may be made to the configurations, operations and details of the methods and devices of the invention without departing from the spirits of the invention and the scope defined by the claims. For example, modifications or changes may be made to part of the structure of the invention with reference to the technical solutions as described in the patents listed in Background Art, and the modifications or changes are covered by the scope of the invention as long as they adopts the features of the invention to form a spherical expansion compressor adapted to variable working conditions.

The invention claimed is:

1. A spherical expansion compressor adapted to variable working conditions and having a spherical inner chamber, characterized in that, the spherical expansion compressor comprises:

a rolling rotor compressor used as a first-stage compression, with an exhaust valve arranged at an outlet port thereof and a pressure-controlled inlet valve mounted at an inlet port thereof, wherein the rolling rotor compressor comprises a rotor and a rotor cylinder, the rotor of the rolling rotor compressor being of an eccentric structure arranged on a main shaft, and the rotor cylinder of the rolling rotor compressor being positioned between said cylinder and a main shaft support which supports the main shaft;

compression working chambers used as a second-stage compression and arranged in the spherical inner chamber;

expansion working chambers used as at least one-stage expansion arranged in the spherical inner chamber;

a gas tank, with its inlet port in communication with the exhaust valve of the rolling rotor compressor and its outlet port in communication with an inlet port of the second-stage compression of the spherical expansion compressor, for supplying gas sources of constant pressure for the gas suction of the second-stage compression of the spherical expansion compressor; and a pressure control circuit arranged between the gas tank and the pressure-controlled inlet valve, for controlling the pressure-controlled inlet valve to open/close according to the pressure in the gas tank;

wherein when the pressure in the gas tank exceeds a set value, the pressure-controlled inlet valve is closed by the pressure control circuit, and when the pressure in the gas tank returns to the set value, the pressure-controlled inlet valve is opened and the rolling rotor compressor works normally; a working medium after the first-stage compression enters the gas tank, and the pressure in the tank is maintained constant through regulation by the pressure control circuit; after entering the second-stage compression, the working medium of constant pressure is expanded at an expansion stage, thereby forming the spherical expansion compressor adapted to variable working conditions.

2. The spherical expansion compressor adapted to variable working conditions according to claim 1, characterized in that, the spherical expansion compressor comprises:

a cylinder and a cylinder head, and the cylinder head is connected to the cylinder to form the spherical inner chamber, the cylinder head having a parting surface, and a main shaft hole is arranged on the cylinder, and a shaft hole matching a piston shaft is arranged on the cylinder head;

a piston arranged in the spherical inner chamber and having a spherical top surface, a piston shaft projecting from the center of the spherical top surface and a piston pin seat at a lower end face of the piston, the piston being rotatable freely around the piston shaft in the shaft hole of the cylinder head, and the spherical top surface of the piston having the same spherical center as that of the spherical inner chamber and forming a hermetic running fit therewith; the piston pin seat being an inwards recessed semicylindrical hole formed at the lower end face of the piston, and there being a recessed sector-shaped cavity along the axial direction of the semicylindrical hole at the inner circumference of the semicylindrical hole, the recessed sector-shaped cavity running through along the axial direction of the semicylindrical hole and being sector-shaped on a section perpendicular to the axis of the semicylindrical hole;

a rotary disk having an upper part and a lower end face, the rotary disk having a rotary disk shaft projecting from the center of the lower end face of the rotary disk and a rotary disk pin seat corresponding to the piston pin seat at the upper part of the rotary disk; the outer circumferential face between the upper part and lower end face of the rotary disk being a rotary disk spherical face, and the rotary disk spherical face having the same spherical center as that of the spherical inner chamber and closely confronts the spherical inner chamber thereby forming a hermetic running fit therewith; the rotary disk pin seat being an annular body projecting from the upper part of the rotary disk, the axis of the annular body being the same axis as that of the semicylindrical hole of the piston, and the axis being perpendicular to the rotary disk shaft and the piston shaft and passing through the spherical center of the spherical inner chamber; and a convex sector-shaped bump being formed along the axial direction of the annular body on the outer circumference of the annular body of the rotary disk pin seat, the convex sector-shaped bump running through along the axial direction of the annular body, being sector shaped on the annular face, and matching the recessed sector-shaped cavity of the piston pin seat and having the same center of sector as that of the piston pin seat;

a main shaft with a first end within the cylinder having an eccentric shaft hole, the eccentric shaft hole matching the rotary disk shaft and forming a cylindrical sliding bearing fit with the rotary disk shaft and a second end being connected to a power mechanism for supplying power to vary the volume of the compressor;

wherein the inlet port of the rolling rotor compressor being arranged on the rotor cylinder, the outlet port of the rolling compressor being arranged on the main shaft support, and a sliding piece and a sliding piece spring being arranged on the rotor cylinder;

a piston hinge support with one end being a planar end, wherein the planar end comprises planar end faces, and the other end being a spherical end face, the spherical end face matching the spherical inner chamber, the shapes of the planar end faces and side faces of the piston hinge supports matching the structures of two ends of the piston pin seat and two ends of the rotary disk pin seat, the piston hinge supports being fixed to two ends of the semicylindrical hole of the piston pin seat, and a spherical face matching the spherical inner chamber being formed at the two ends of the piston pin seat and the two ends of the rotary disk pin seat; the piston hinge support having a pin hole therein which is coaxial with the semicylindrical hole of the piston pin seat, the pin hole being a blind hole arranged at the center of the planar end of the piston hinge support; and a central pin being inserted into the pin hole of the piston hinge support and an inner hole of the annular body of the rotary disk pin seat, such that the piston and the rotary disk form a cylindrical hinge connection;

wherein working chambers V7 and V8 whose volumes vary in an alternative manner are formed between the upper part of the rotary disk, the lower and face of the piston, the planar end faces of the piston hinge supports and the spherical inner chamber by relative swinging of the piston and the rotary disk around the central pin, and at the same time, working chambers V5 and V6 whose volumes vary in an alternative manner are formed between a side of the convex sector-shaped bump, a side of the recessed sector-shape cavity and the planar end faces of the piston hinge supports by swinging of the convex sector-shaped bump of the annular body of the rotary disk pin seat in the recessed sector-shaped cavity of the semicylindrical hole of the piston pin seat; and wherein both working chambers V5 and V6 correspond to a gas channel and an inlet and outlet channels respectively, the gas channel being arranged on the piston, and the inlet and outlet channels being arranged on a surface of the spherical inner chamber of the cylinder head and within an annular space perpendicular to the piston axis and in communication with the outside of the cylinder; the a exhaust is controlled by the rotation of the piston, and when gas intake or exhaust is needed for each of the working chambers, the gas channel is in communication with the corresponding inlet and outlet channels.

3. The spherical expansion compressor adapted to variable working conditions according to claim 2, characterized in that, a central line of a circle of the location where the main shaft matches the main shaft hole in the cylinder coincides with the central line of the main shaft, and the axis of the part of the main shaft corresponding to the rotor cylinder does not coincide with the annular central line of the rotor cylinder; an eccentric column is formed on the main shaft, the central line of the eccentric column being parallel with the central line of the main shaft, the eccentric column being tangential to the inner annulus of the rotor cylinder, and the sliding piece always closely confronting the outer circle of the eccentric column of the main shaft by the sliding piece spring, the main shaft with the eccentric column being used as the rotor of the rolling rotor compressor, the rolling rotor compressor being formed between the main shaft support and the cylinder, and an inlet chamber V1 and an outlet chamber V2 of the rolling rotor compressor being formed between the rotor cylinder and the main shaft when the main shaft rotates.

4. The spherical expansion compressor adapted to variable working conditions according to claim 2, characterized in that, the all the axes of piston shaft, the rotary shaft and the main shaft pass through the spherical center of the spherical inner chamber.

5. The spherical expansion compressor adapted to variable working conditions according to claim 2, characterized in that, the axes of the piston shaft and of the rotary shaft form an angle $\alpha$ with respect to the axis of the main shaft, with an optimal range of $\alpha$ being 5°-15°.

6. The spherical expansion compressor adapted to variable working conditions according to claim 2, characterized in that, the moment of inertia of the piston around the axis of the piston is close to or equals to the moment of inertia of the rotary disk around the axis of the rotary disk.

7. The spherical expansion compressor adapted to variable working conditions according to claim 2, characterized in that, the parting face of the cylinder head and the cylinder locates on a plane which is perpendicular to the piston shaft and passes through the spherical center of the spherical inner chamber.

8. The spherical expansion compressor adapted to variable working conditions according to claim 1, characterized in that, the cylinder diameter of the spherical inner chamber is 40-150 millimeters.

9. The spherical expansion compressor adapted to variable working conditions according to claim 2, characterized in that, there is a sector-shaped sliding channel at the lower part of the annular body of the rotary disk pin seat, the sector-shaped sliding channel opening in the axial direction of the annular body, the sector-shaped sliding channel having an upper circular face and a lower circular face, the axis of the sector-shaped sliding channel being parallel with the axis of the annular body, a slider being arranged in the sector-shaped sliding channel, the shape of the slider matching the shape of the sector-shaped sliding channel, the slider having an upper circular face and a lower circular face and two end faces, the upper and lower circular faces of the slider closely confronting the upper and lower circular faces of the sector-shaped sliding channel thereby forming a hermetic running fit therewith, and the two end faces of the slider being abutted against the piston hinge support and fixedly connected by positioning bolts; when the piston swings relative to the rotary disk, working chambers V3 and V4 whose volumes vary in an alternative manner being formed between a side of the slider, a side of the sector-shaped sliding channel and the planar end faces of the piston hinge supports;

the working chambers V3 and V4 corresponding to a gas channel and an inlet and outlet channels respectively; the gas channel being arranged on the piston hinge support, and the inlet and outlet channels being arranged on the spherical inner chamber of the cylinder and within the annular space perpendicular to the piston axis and in communication with the outside of the cylinder; the gas exhaust is controlled by the rotation of the piston, and when gas intake or exhaust is needed by each of the working chambers, the gas channel being in communication with the corresponding inlet and outlet channels;

a through hole channel being arranged on the rotary disk and communicating the working chambers V7 and V8, such that the working chambers V7 and V8 are unable to compress, thereby forming a non-compressed volume; and the rolling rotor compressor being used as first-stage compression, the working chambers V3 and V4 being used as second-stage compression, and the working chambers V5 and V6 being used as expansion, forming a compressor of two-stage compression and one-stage expansion adapted to variable working conditions.

10. The spherical expansion compressor adapted to variable working conditions according to claim 9, characterized in that, a cylinder head drain hole corresponding to the working chambers V7 and V8 is arranged in the cylinder head, for discharging lubricant possibly accumulated in the non-compressed volume.

11. The spherical expansion compressor adapted to variable working conditions according to claim 2, characterized in that, an arcuate opening is arranged at the lower part of the annular body of the rotary disk pin seat, the arcuate opening opening in the axial direction of the annular body, the axis of the arcuate opening being parallel with the axis of the annular body, a supporting bushing being movably arranged in the arcuate opening, the supporting bushing being of a cylindrical shape with through holes therein for bolt therethrough, the supporting bushing having two end faces, and the two end faces of the supporting bushing being abutted against the planar end face of the piston hinge supports and the supporting bushing and the piston hinge supports being connected by positioning bolts;

the working chambers V7 and V8 corresponding to a gas channel and an inlet and outlet channels respectively; the gas channel of the working chambers V7 and V8 being arranged within the piston hinge support, with one end of the gas channel being on the spherical surface of the piston and a second end being on the lower end face of the piston and in communication with a guiding slot which is arranged on the lower end face and is dose to the spherical surface; the inlet and outlet channels of the working chambers V7 and V8 being arranged on an inner face of the spherical inner chamber of the cylinder head and within the annular space which is perpendicular to the piston axis and in communication with the outside of the cylinder; and the gas exhaust is controlled by the rotation of the piston, and when gas intake or exhaust is needed by each of the working chambers, the gas channel being in communication with the corresponding inlet and outlet channels;

the rolling rotor compressor being used as first stage compression, the working chambers V7 and V8 being used as second-stage compression, and the working chambers V5 and V6 being used as expansion, thereby forming an expansion compressor of two-stage compression and one stage expansion adapted to variable working conditions.

12. The spherical expansion compressor adapted to variable working conditions according to claim 11, characterized in that, the lower end face of the piston is a planar plane, the planar plane being at a position below the spherical center of the spherical top surface of the piston.

13. The spherical expansion compressor adapted to variable working conditions according to claim 12, characterized in that, a value of a minimum distance h from the lower end face of the piston to the spherical center is at least greater than 1 millimeter, and an upper end face of the piston is based on the lower end face of the piston and matches the lower end face.

14. The spherical expansion compressor adapted to variable working conditions according to claim 11, characterized in that, a rotary disk drain hole is arranged in the rotary disk and communicating the lower part of the arcuate opening and a root of the lower end of the sphere of the rotary disk, for discharging the liquid possibly accumulated in the inner chamber of the arcuate opening and preventing liquid strike.

15. The spherical expansion compressor adapted to variable working conditions according to claim 2, characterized in that, the axes of the piston shaft and of the rotary disk shaft form an identical angle $\alpha$ with respect to the axis of the main shaft, with an optimal range of $\alpha$ being 5°-15°;

the moment of inertia of he piston around the axis of the piston is close to or equals to the moment of inertia of the rotary disk around the axis of the rotary disk; and the main shaft rotates clockwise when viewed along the direction of the main shaft from the cylinder head.

16. The spherical expansion compressor adapted to variable working conditions according to claim 15, further comprising a slider, there being a sector-shaped sliding channel at the lower part of the annular body of the rotary disk pin seat, the sector-shaped sliding channel opening in the axial direction of the annular body, the sector-shaped sliding channel having an upper circular face and a lower circular face, the axis of the sector-shaped sliding channel being parallel with the axis of the annular body, the shape of the slider matching the shape of the sector-shaped sliding channel, the slider having an upper circular face and a lower circular face and two end faces, the upper and lower circular faces of the slider closely confronting the upper and lower circular faces of the sector-shaped sliding channel thereby forming a hermetic running fit therewith, and the two end faces of the slider being abutted against the piston hinge supports and the slider and the piston hinge supports being connected by positioning bolts; when the piston swings relative to the rotary disk, working chambers V3 and V4 whose volumes vary in an alternative manner being formed between a side of the slider, a side of the sector-shaped sliding channel and the planar end faces of the piston hinge supports; the working chambers V3 and V4 corresponding to a gas channel and an inlet and outlet channels respectively; the gas channel being arranged on the piston hinge support, and the inlet and outset channels being arranged on the inner surface of the spherical inner chamber of the cylinder and within the annular space which is perpendicular to the piston axis and in communication with the outside of the cylinder; the gas exhaust is controlled by the rotation of the piston, and when gas intake or exhaust is needed by each of the working chambers, the gas channel being in communication with the corresponding inlet and outlet channels;

a through hole channel being arranged on the rotary disk and communicating the working chambers V7 and V8, such that the working chambers V7 and V8 are unable to compress, thereby forming a non-compressed volume; and a cylinder head drain hole being arranged in the cylinder head, for discharging such substances as lubricant, etc, possibly accumulated in the non-compressed volume; and the rolling rotor compressor being used as first-stage compression, the working chambers V3 and V4 being used as second-stage compression, and the working chambers V5 and V6 being used as expansion stage, thereby forming a compressor of two-stage compression and one-stage expansion adapted to variable working conditions.

17. The spherical expansion compressor adapted to variable working conditions according to claim 15, further comprising a supporting bushing, there being an arcuate opening at the lower part of the rotary disk pin seat, the arcuate opening in the axial direction of the annular body, the axis of the arcuate opening being parallel with the axis of the annular body, the supporting bushing being of a cylindrical shape with a through hole therein for bolt therethrough, the supporting bushing having two end faces, the supporting bushing being movable within the arcuate opening, and the two end faces of the supporting bushing being abutted against the planar end faces of the piston hinge supports, and the supporting bushing and the piston hinge supports being connected by positioning bolts; a rotary disk drain hole being arranged in the rotary disk and communicating the lower part of the arcuate opening and the root of the lower end of the sphere of the rotary disk, thereby discharging the liquid possibly accumulated in the inner chamber of the arcuate opening and preventing liquid strike;

the working chambers V7 and V8 corresponding to a gas channel and an inlet and outlet channels respectively; the gas channel of the working chambers V7 and V8 being arranged within the piston hinge support, with one end of the gas channel being on the spherical surface of the piston and the other end being on the lower end face of the piston and in communication with a guiding slot which is arranged on the lower end face and close to the spherical surface; the inlet and outlet channels of the working chambers V7 and V8 being arranged on an inner surface of the spherical inner chamber of the cylinder head and within the annular space which is perpendicular to the piston axis and in communication with the outside of the cylinder; and the gas exhaust is controlled by the rotation of the piston, and when gas intake or exhaust is needed by each of the working chambers, the gas channel being in communication with the corresponding inlet and outlet channels;

the rolling rotor compressor being used as first-stage compression, the working chambers V7 and V8 being used as second-stage compression, and the working chambers V5 and V6 being used as expansion stage, thereby forming an expansion compressor of two-stage compression and one-stage expansion adapted to variable working conditions.

18. The spherical expansion compressor adapted to variable working conditions according to claim 15, characterized in that, the optimal cylinder diameter of the spherical inner chamber is 40-150 millimeters.

19. The spherical expansion compressor adapted to variable working conditions according to claim 15, characterized in that, the parting face of the cylinder head and the cylinder locates on the plane which is perpendicular to the piston shaft and passes through the spherical center of the spherical inner chamber.

* * * * *